US010074300B2

(12) United States Patent
Yeon et al.

(10) Patent No.: US 10,074,300 B2
(45) Date of Patent: Sep. 11, 2018

(54) METHOD OF DRIVING DISPLAY PANEL TO REDUCE FUZZ AT IMAGE BOUNDARY AND DISPLAY APPARATUS FOR PERFORMING THE SAME

(71) Applicant: SAMSUNG DISPLAY CO., LTD., Yongin-si, Gyeonggi-Do (KR)

(72) Inventors: Yeun-Mo Yeon, Asan-si (KR); Seung-Hyun Ko, Asan-si (KR); Choong-Yull Kwak, Seoul (KR); Dal-Jung Kwon, Seoul (KR); Jin-Tae Kim, Asan-si (JP); Se-Young Oh, Cheonan-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 29 days.

(21) Appl. No.: 14/994,547

(22) Filed: Jan. 13, 2016

(65) Prior Publication Data

US 2017/0032730 A1 Feb. 2, 2017

(30) Foreign Application Priority Data

Jul. 27, 2015 (KR) ..... 10-2015-0105924

(51) Int. Cl.
*G09G 3/36* (2006.01)
*G09G 3/20* (2006.01)

(52) U.S. Cl.
CPC ..... *G09G 3/2074* (2013.01); *G09G 3/3607* (2013.01); *G09G 2320/0613* (2013.01); *G09G 2320/0673* (2013.01)

(58) Field of Classification Search
CPC ..... G09G 3/2074; G09G 3/3607; G09G 2320/0673; G09G 2320/0613
See application file for complete search history.

(56) References Cited

U.S. PATENT DOCUMENTS

| | | | | |
|---|---|---|---|---|
| 8,026,925 | B2 | 9/2011 | Lee et al. | |
| 2001/0055415 | A1* | 12/2001 | Nozaki | G01N 21/8851 382/141 |
| 2011/0012941 | A1* | 1/2011 | Shin | G09G 3/3648 345/690 |
| 2011/0242149 | A1* | 10/2011 | Yoshida | G09G 3/3648 345/690 |
| 2012/0093363 | A1* | 4/2012 | Hoshikawa | H04N 5/367 382/103 |
| 2013/0335688 | A1* | 12/2013 | Jung | G02F 1/134336 349/130 |
| 2014/0043571 | A1* | 2/2014 | Chang | G02F 1/139 349/123 |
| 2016/0131948 | A1* | 5/2016 | Zheng | G02F 1/133305 349/110 |
| 2016/0358574 | A1* | 12/2016 | Hohjoh | G09G 3/3677 |

FOREIGN PATENT DOCUMENTS

| | | |
|---|---|---|
| KR | 1020070032108 | 3/2007 |
| KR | 1020090043879 | 5/2009 |

* cited by examiner

*Primary Examiner* — Kwang-Su Yang
(74) *Attorney, Agent, or Firm* — F. Chau & Associates, LLC

(57) ABSTRACT

A display panel includes a plurality of pixels arranged in a matrix, each of the pixels including a high sub-pixel and a low sub-pixel. A method of driving the display panel may include detecting a first pixel which corresponds to a first pattern in an image, and changing a gray scale value of the high or low sub-pixel of a second pixel which is adjacent to the first pixel.

16 Claims, 17 Drawing Sheets

METHOD OF DRIVING DISPLAY PANEL TO REDUCE FUZZ AT IMAGE BOUNDARY AND DISPLAY APPARATUS FOR PERFORMING THE SAME

CROSS-REFERENCE TO RELATED APPLICATION

This application claims priority under 35 U.S.C. § 119 to Korean Patent Application No. 10-2015-0105924, filed on Jul. 27, 2015, the disclosure of which is incorporated by reference herein in its entirety.

TECHNICAL FIELD

Exemplary embodiments of the inventive concept relate to a method of driving a display panel and a display apparatus for performing the method.

DESCRIPTION OF THE RELATED ART

A liquid crystal display apparatus may be driven by a specific liquid crystal arrangement mode and a specific sub-pixel driving mode to achieve a wide viewing angle. However, when the liquid crystal display apparatus displays an image having a specific pattern, a boundary of the specific pattern may be fuzzy.

SUMMARY

According to an exemplary embodiment of the inventive concept, a display panel includes a plurality of pixels arranged in a matrix, each of the pixels comprising a high sub-pixel and a low sub-pixel. A method of driving the display panel may include detecting a first pixel which corresponds to a first pattern in an image, and changing a gray scale value of the high or low sub-pixel of a second pixel which is adjacent to the first pixel.

In an exemplary embodiment of the inventive concept, the high sub-pixels may be driven by a first gamma curve. The low sub-pixels may be driven by a second gamma curve which is different from the first gamma curve.

In an exemplary embodiment of the inventive concept, when a gray scale value of one of the high or low sub-pixel is changed, a gray scale value of the other of the high or low sub-pixel may not be changed.

In an exemplary embodiment of the inventive concept, the second pixel may be adjacent to the first pixel in a direction in which a data line is extended. A gray scale value of the high or low sub-pixel of the second pixel which is closer to the first pixel may be changed.

In an exemplary embodiment of the inventive concept, the gray scale value of the high or low sub-pixel may be changed when an image produced at the high or low sub-pixel is darker than an image intended to be produced at the high or low sub-pixel.

In an exemplary embodiment of the inventive concept, the gray scale value of the high or low sub-pixel may be changed when an image produced at the high or low sub-pixel is brighter than an image intended to be produced at the high or low sub-pixel.

In an exemplary embodiment of the inventive concept, the first pixel may be detected by deciding whether a difference between gray scale values of continuous pixels is greater than 50% of a total gray scale value range or not.

In an exemplary embodiment of the inventive concept, the first pattern may be text.

In an exemplary embodiment of the inventive concept, the high sub-pixel and the low sub-pixel may be electrically connected to different switching elements.

In an exemplary embodiment of the inventive concept, the high sub-pixel and the low sub-pixel in one pixel may be overlapped with a color filter which has one color.

In an exemplary embodiment of the inventive concept, the high sub-pixel and the low sub-pixel in the one pixel may be arranged along a direction in which a data line is extended.

In an exemplary embodiment of the inventive concept, a light blocking pattern may divide the one pixel into two portions.

In an exemplary embodiment of the inventive concept, the display panel may further include a liquid crystal layer, and the display panel may be driven by a vertical alignment mode.

In an exemplary embodiment of the inventive concept, the display panel may be a curved display panel which displays an image on a curved surface.

In an exemplary embodiment of the inventive concept, the high sub-pixel and the low sub-pixel in the one pixel may be arranged along a direction in which a gate line is extended.

According to an exemplary embodiment of the inventive concept, a display apparatus includes a timing controller configured to output an output image data to a first pixel to display a first pattern and a second pixel which is adjacent to the first pixel, and a display panel comprising a plurality of pixels arranged in a matrix form. Each of the pixels includes a high sub-pixel driven based on a first gamma curve and a low sub-pixel driven based on a second gamma curve. At least one of a gray scale value of the high or low sub-pixel among the output image data which is inputted to the second pixel is changed.

In an exemplary embodiment of the inventive concept, the timing controller may detect the first pixel which corresponds to the first pattern in an input image data by analyzing the input image data. The timing controller may generate a first image data which corresponds to the first pixel, and a second image data which corresponds to the second pixel. The timing controller may generate the output image data based on the first and second image data. The display panel may display an image based on the output image data.

In an exemplary embodiment of the inventive concept, the first pattern may be text.

In an exemplary embodiment of the inventive concept, the display panel may further include a liquid crystal layer. The display panel may be driven by a vertical alignment mode. The display panel may be a curved display to display an image on a curved surface.

According to an exemplary embodiment of the inventive concept, a method of driving a display panel, which comprises a plurality of pixels arranged in a matrix form, each pixel having a high sub-pixel and a low sub-pixel, may comprise: detecting a first pixel which corresponds to text; and correcting a gray scale value of the high or low sub-pixel of a second pixel, which is adjacent to the first pixel, to have a brighter value or a darker value.

According to an exemplary embodiment of the inventive concept, a method of driving a display panel, the display panel comprising a plurality of pixels arranged in a matrix, each of the pixels comprising a first sub-pixel and a second sub-pixel, may comprise: detecting pixels included in a pattern in an image; detecting at least one pixel adjacent to at least one of the pixels included in the pattern; identifying that an intensity of the at least one adjacent pixel is greater or less than its desired intensity; and correcting the intensity of the at least one adjacent pixel to be closer to its desired intensity.

The pixels included in the pattern may be detected based on their intensities.

The at least one adjacent pixel may be detected based on its intensity.

BRIEF DESCRIPTION OF THE DRAWINGS

The above and other features of the inventive concept will become more apparent by describing in detail exemplary embodiments thereof with reference to the accompanying drawings, in which.

DETAILED DESCRIPTION OF THE EMBODIMENTS

Hereinafter, exemplary embodiments of the inventive concept will be explained in detail with reference to the accompanying drawings.

Figure 1:
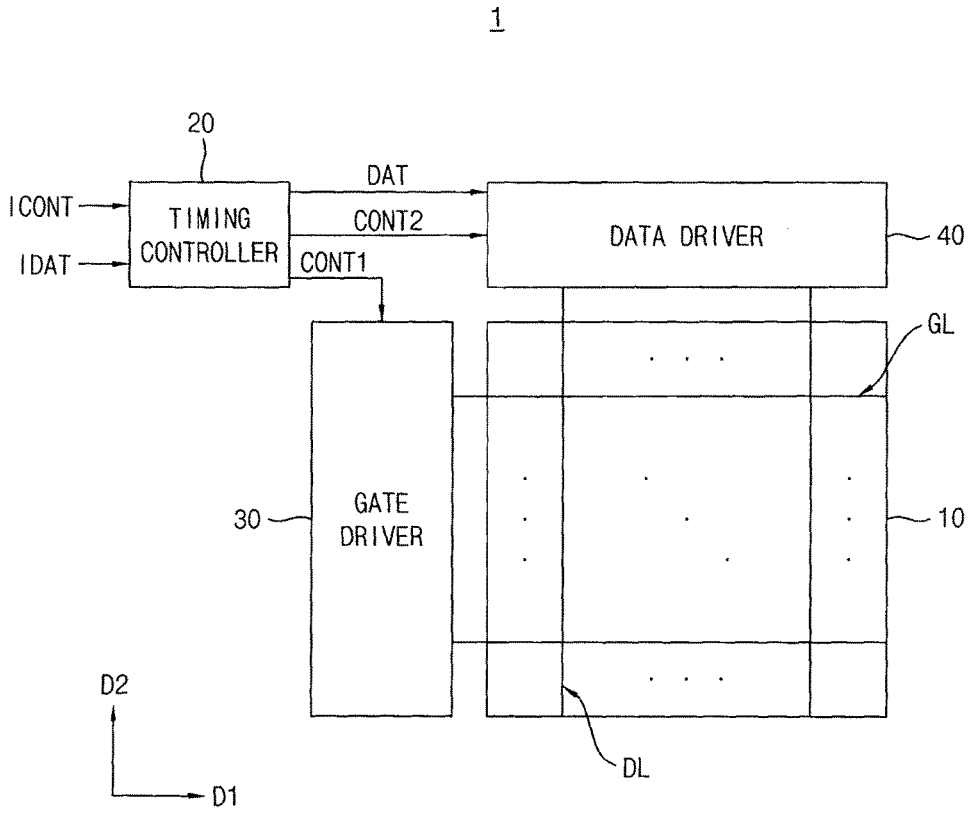
FIG. 1 is a block diagram illustrating a display apparatus according to an exemplary embodiment of the inventive concept.

FIG. 1 is a block diagram illustrating a display apparatus 1 according to an exemplary embodiment of the inventive concept.

Referring to FIG. 1, the display apparatus 1 includes a display panel 10, a timing controller 20, a gate driver 30 and a data driver 40.

The display panel 10 is connected to a plurality of gate lines GL and a plurality of data lines DL. The display panel 10 displays an image represented by a plurality of grayscales based on output image data DAT from the timing controller 20. The gate lines GL may extend in a first direction D1, and the data lines DL may extend in a second direction D2 crossing (e.g., substantially perpendicular to) the first direction D1.

The display panel 10 may include a plurality of pixels that are arranged in a matrix form. Each pixel may be electrically connected to a respective one of the gate lines GL and a respective one of the data lines DL.

In an exemplary embodiment of the inventive concept, each pixel may include a switching element, a liquid crystal capacitor and a storage capacitor. The liquid crystal capacitor and the storage capacitor may be electrically connected to the switching element. For example, the switching element may be a thin film transistor. The liquid crystal capacitor may include a first electrode connected to a pixel electrode and a second electrode connected to a common electrode. A data voltage may be applied to the first electrode of the liquid crystal capacitor. A common voltage may be applied to the second electrode of the liquid crystal capacitor. The storage capacitor may include a first electrode connected to the pixel electrode and a second electrode connected to a storage electrode. The data voltage may be applied to the first electrode of the storage capacitor. A storage voltage may be applied to the second electrode of the storage capacitor. The storage voltage may be substantially equal to the common voltage.

Each pixel may have a rectangular shape. For example, each pixel may have a relatively short side in the first direction D1 and a relatively long side in the second direction D2. The relatively short side of each pixel may be substantially parallel to the gate lines GL. The relatively long side of each pixel may be substantially parallel to the data lines DL.

The timing controller 20 controls an operation of the display panel 10 and controls operations of the gate driver 30 and the data driver 40. The timing controller 20 receives input image data IDAT and an input control signal ICONT from an external device (e.g., a graphic processor). The input image data IDAT may include a plurality of input pixel data for the plurality of pixels. The input pixel data may include red grayscale data R, green grayscale data G and blue grayscale data B. The input control signal ICONT may include a master clock signal, a data enable signal, a vertical synchronization signal, a horizontal synchronization signal, etc.

The timing controller 20 generates the output image data DAT, a first control signal CONT1 and a second control signal CONT2 based on the input image data IDAT and the input control signal ICONT.

The timing controller 20 may generate the output image data DAT based on the input image data IDAT. The output image data DAT may be provided to the data driver 40. The timing controller 20 may generate the first control signal CONT1 based on the input control signal ICONT. The first control signal CONT1 may be provided to the gate driver 30, and a driving timing of the gate driver 30 may be controlled based on the first control signal CONT1. The first control signal CONT1 may include a vertical start signal, a gate clock signal, etc. The timing controller 20 may generate the second control signal CONT2 based on the input control signal ICONT. The second control signal CONT2 may be provided to the data driver 40, and a driving timing of the data driver 40 may be controlled based on the second control signal CONT2. The second control signal CONT2 may include a horizontal start signal, a data clock signal, a data load signal, a polarity control signal, etc.

The gate driver 30 receives the first control signal CONT1 from the timing controller 20. The gate driver 30 generates a plurality of gate signals for driving the gate lines GL based on the first control signal CONT1. The gate driver 30 may sequentially apply the gate signals to the gate lines GL.

The data driver 40 receives the second control signal CONT2 and the output image data DAT from the timing controller 20. The data driver 40 generates a plurality of analog data voltages based on the second control signal CONT2 and the digital output image data DAT. The data driver 40 may apply the data voltages to the data lines DL.

In an exemplary embodiment of the inventive concept, the data driver 40 may include a shift register, a latch, a signal processor and a buffer. The shift register may output a latch pulse to the latch. The latch may temporarily store the output image data DAT, and may output the output image data DAT to the signal processor. The signal processor may generate the analog data voltages based on the digital output image data DAT and may output the analog data voltages to the buffer. The buffer may output the analog data voltages to the data lines DL.

In an exemplary embodiment of the inventive concept, the gate driver 30 and/or the data driver 40 may be disposed, e.g., directly mounted, on the display panel 10, or may be connected to the display panel 10 in a tape carrier package (TCP) type. In addition, the gate driver 30 and/or the data driver 40 may be integrated on the display panel 10.

Figure 2:
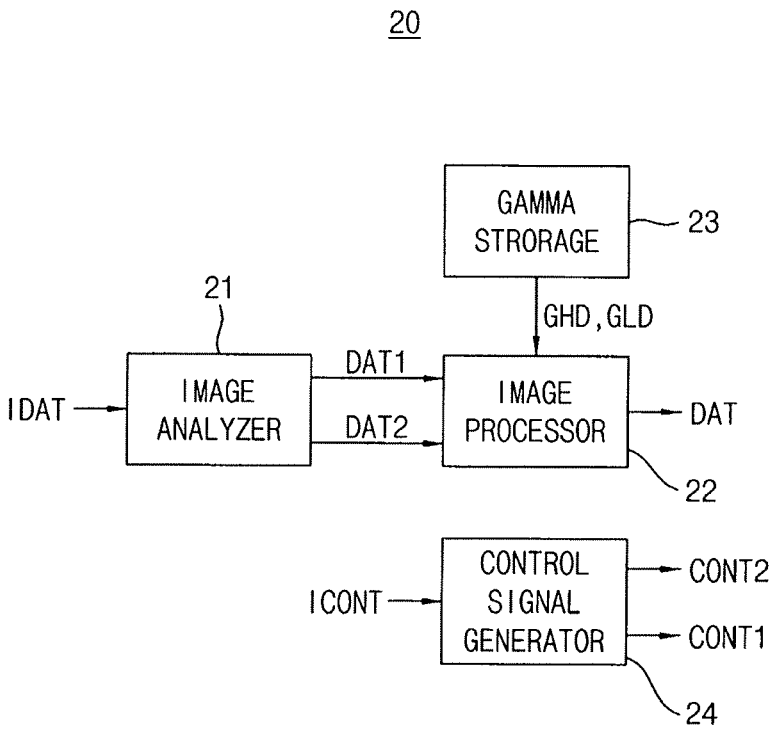
FIG. 2 is a block diagram illustrating a timing controller included in a display apparatus according to an exemplary embodiment of the inventive concept.

FIG. 2 is a block diagram illustrating a timing controller 20 included in a display apparatus according to an exemplary embodiment of the inventive concept.

Referring to FIGS. 1 and 2, the timing controller 20 may analyze an input image data IDAT and generate a first image data DAT1 and a second image data DAT2. The timing controller 20 may generate an output image data DAT based on the first image data DAT1 and the second image data DAT2. The first image data DAT1 may be for adjacent pixels which are adjacent to specific pixels of a specific pattern which is displayed on the display panel 10 by the input image data IDAT, and the second image data DAT2 may be for pixels other than the adjacent pixels.

The timing controller 20 may include an image analyzer 21, an image processor 22, a gamma storage 23 and a control signal generator 24.

The image analyzer 21 may analyze the input image data IDAT to extract the specific pattern, and generate the first image data DAT1 which corresponds to the adjacent pixel which is adjacent to the specific pattern, and generate the second image data DAT2 which corresponds to a pixel other than the adjacent pixel.

For example, the image analyzer 21 may analyze the input image data IDAT to extract high frequency components and low frequency components from the input image data IDAT. The image analyzer 21 may determine a region corresponding to the high frequency components as the specific pattern. Thus, the image analyzer 21 may determine the specific pixel which corresponds to the specific pattern and the adjacent pixel which is adjacent to the specific pixel in a second direction D2. Accordingly, the image analyzer 21 may generate the first image data DAT1 corresponding to the adjacent pixel and the second image data DAT2 corresponding to the pixel other than the adjacent pixel.

Figure 4:
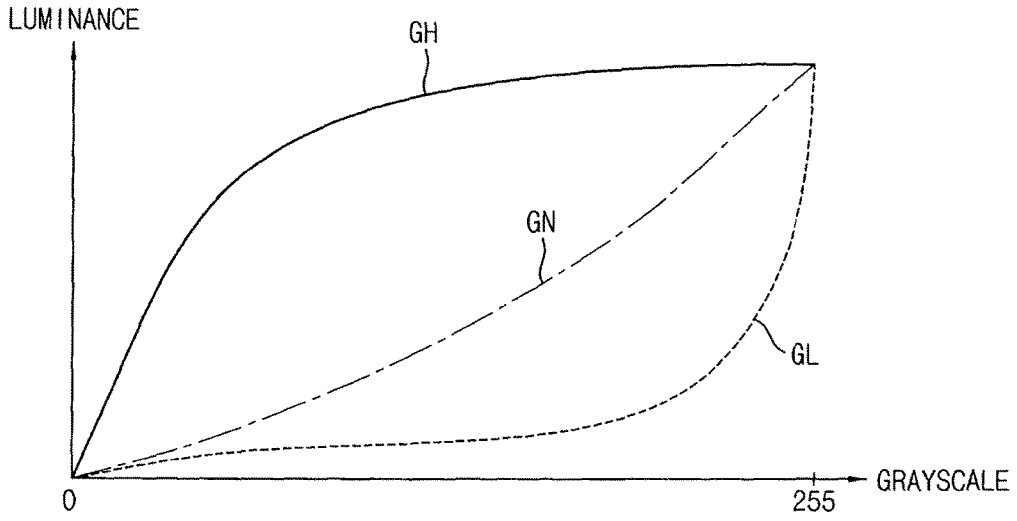
FIG. 4 is a graph illustrating a gamma curve which is used to drive a display panel included in a display apparatus according to an exemplary embodiment of the inventive concept.

The gamma storage 23 may store a first gamma data GHD associated with a first gamma curve (refer to GH of FIG. 4) and second gamma data GLD associated with a second gamma curve (refer to GL of FIG. 4). For example, the gamma storage 23 may include at least one nonvolatile memory such as an erasable programmable read-only memory (EPROM), an electrically erasable programmable read-only memory (EEPROM), a flash memory, a phase change random access memory (PRAM), a resistance random access memory (RRAM), a magnetic random access memory (MRAM), a ferroelectric random access memory (FRAM), a nano floating gate memory (NFGM), a polymer random access memory (PoRAM), etc.

The image processor 22 may generate the output image data DAT based on the first and second image data DAT1 and DAT2. For example, the image processor 22 may generate a first portion of the output image data DAT for the adjacent pixel based on the first image data DAT1 and the first and second gamma data GHD and GLD. The image processor 22 may generate a second portion of the output image data DAT for the pixel other than the adjacent pixel based on the first image data DAT1 and the first and second gamma data GHD and GLD.

In an exemplary embodiment of the inventive concept, the image processor 22 may further selectively perform an image quality compensation, a spot compensation, an adaptive color correction (ACC), and/or a dynamic capacitance compensation (DCC) on the first and second image data DAT1 and DAT2 to generate the output image data DAT.

The control signal generator 24 may receive the input control signal ICONT. The control signal generator 24 may generate the first control signal CONT1 for the gate driver 30 and the second control signal CONT2 for the data driver 40 based on the input control signal ICONT. The control signal generator 24 may output the first control signal CONT1 to the gate driver 30 and may output the second control signal CONT2 to the data driver 40.

Figure 3A:
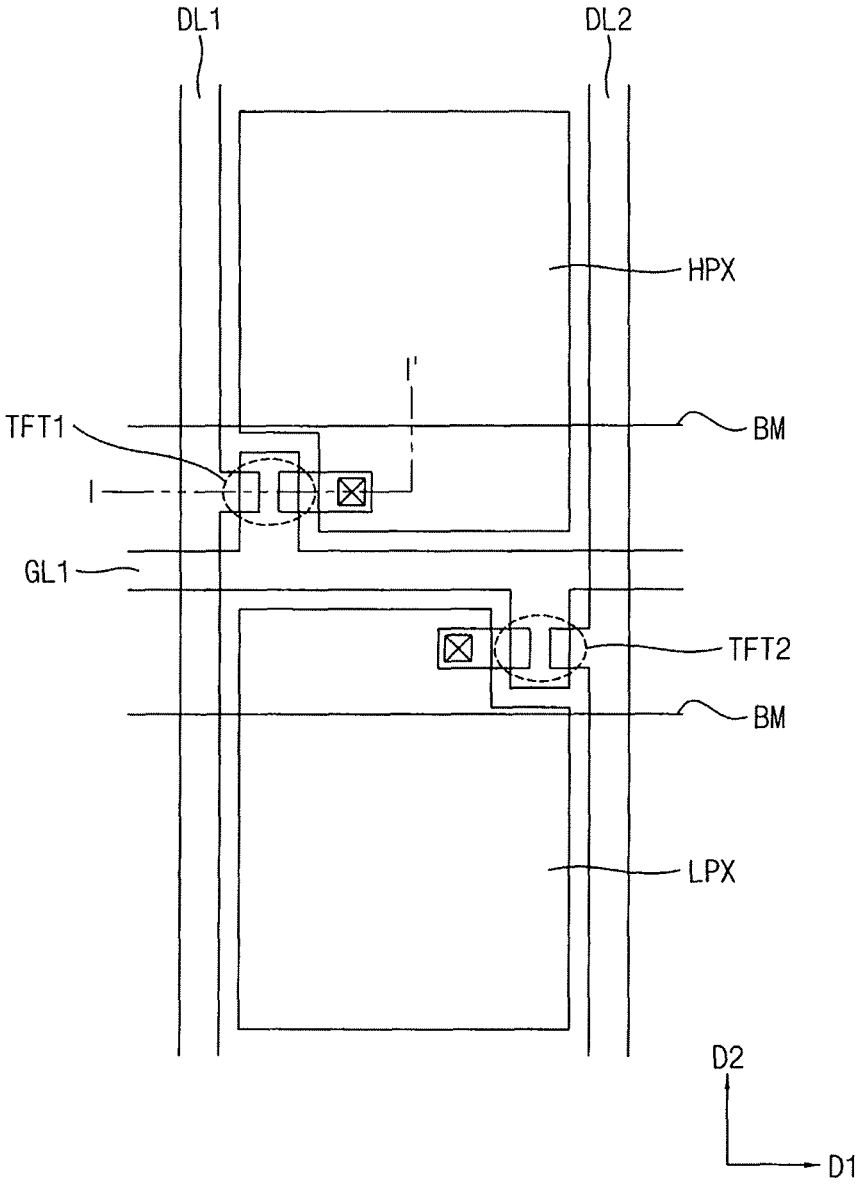
FIG. 3A is plan view illustrating one pixel of a display panel according to an exemplary embodiment of the inventive concept.
Figure 3B:
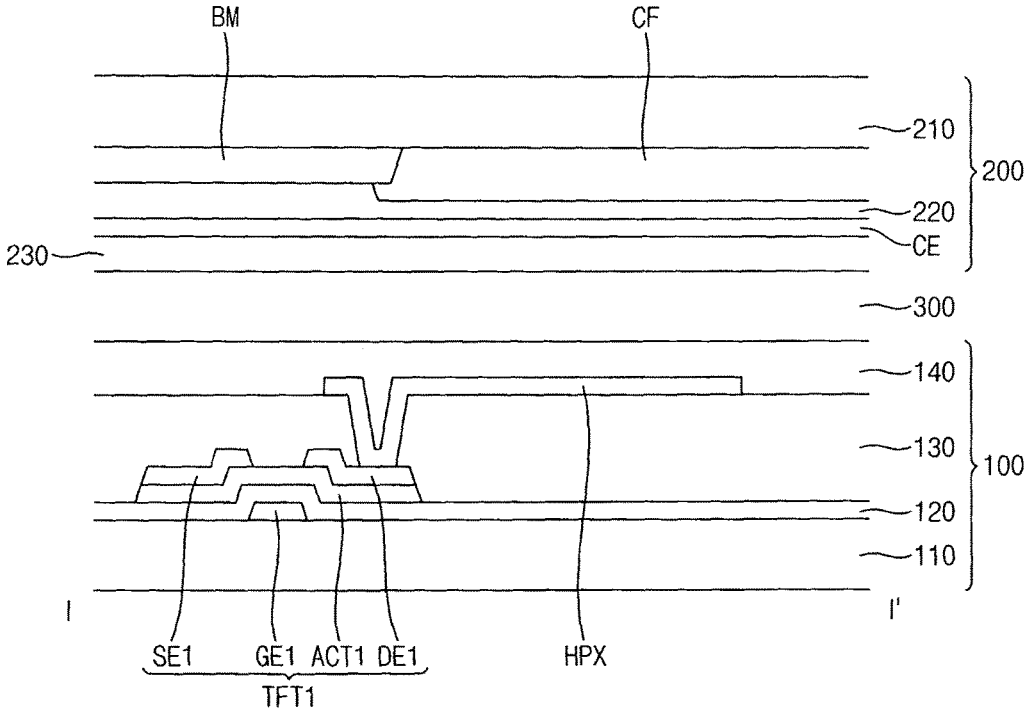
FIG. 3B is a cross-sectional view taken along a line I-I' of FIG. 3A.

FIG. 3A is plan view illustrating one pixel of a display panel according to an exemplary embodiment of the inventive concept. FIG. 3B is a cross-sectional view taken along a line I-I' of FIG. 3A.

Referring to FIGS. 3A and 3B, the display panel may include a first substrate 100, a second substrate 200 and a liquid crystal layer 300.

The first substrate 100 may include a first base substrate 110, a first thin film transistor TFT1, a second thin film transistor TFT2, a first gate line GL1, a first insulation layer 120, a first data line DL1, a second data line DL2, a second insulation layer 130, a high sub-pixel electrode HPX, a low sub-pixel electrode LPX, and a first alignment layer 140.

The first base substrate 110 may include a transparent insulation material. For example, the first base substrate 110 may include a glass substrate, a quartz substrate, a transparent resin substrate, etc. Examples of the transparent resin substrate for the first base substrate 110 may include a polyimide-based resin, an acryl-based resin, a polyacrylate-based resin, a polycarbonate-based resin, a polyether-based resin, a sulfonic acid containing resin, a polyethylene-terephthalate-based resin, etc. In addition, the first base substrate 110 may include a flexible material, so that the display panel 10 may be a flexible display panel or a curved display panel.

A gate pattern may be disposed on the first base substrate 110. The gate pattern may include a metal, an alloy, a conductive metal oxide, a transparent conductive material, etc. For example, the gate pattern may be formed using aluminum (Al), an alloy containing aluminum, aluminum nitride (AlNx), silver (Ag), an alloy containing silver, tungsten (W), tungsten nitride (WNx), copper (Cu), an alloy containing copper, nickel (Ni), an alloy containing nickel, chrome (Cr), chrome nitride (CrNx), molybdenum (Mo), an alloy containing molybdenum, titanium (Ti), titanium nitride (TiNx), platinum (Pt), tantalum (Ta), tantalum nitride (TaNx), neodymium (Nd), scandium (Sc), strontium ruthenium oxide (SRO), zinc oxide (ZnOx), indium tin oxide (ITO), tin oxide (SnOx), indium oxide (InOx), gallium oxide (GaOx), indium zinc oxide (IZO), etc. These may be used alone or in combination. In an exemplary embodiment of the inventive concept, the gate pattern may have a single layer structure or a multi layer structure, which may include a metal film, an alloy film, a metal nitride film, a conductive metal oxide film and/or a transparent conductive film.

The gate pattern may include a signal line to transmit signals for driving the pixel and a storage electrode. For example, the gate pattern may include a first gate electrode GE1, a second gate electrode GE2 (of TFT2) and the first gate line GL1.

The first gate line GL1 may be extended along a first direction D1. The first gate line GL1 may be electrically connected to the first gate electrode GE1 and the second gate electrode GE2.

The first insulation layer 120 may be disposed on the first base substrate 110 on which the gate pattern is disposed. The first insulation layer 120 may be uniformly formed on the first base substrate 110 along a profile of the gate pattern. Here, the first insulation layer 120 may have a substantially small thickness, such that a stepped portion may be formed at a portion of the first insulation layer 120 adjacent to the gate pattern. The first insulation layer 120 may be formed using a silicon compound. For example, the first insulation layer 120 may be formed using silicon oxide, silicon nitride, silicon oxynitride, silicon oxycarbide, aluminum, magnesium, zinc, hafnium, zirconium, titanium, tantalum, aluminum oxide, titanium oxide, tantalum oxide, magnesium oxide, zinc oxide, hafnium oxide, zirconium oxide, titanium oxide, etc. These may be used alone or in a mixture.

An active layer including a first active pattern ACT1 and a second active pattern ACT2 (of TFT2) may be disposed on the first insulation layer 120. The first active pattern ACT1 may overlap the first gate electrode GE1. The second active pattern ACT2 may overlap the second gate electrode GE2. The active layer may include a semiconductor layer consisting of amorphous silicon (a-Si:H) and an ohmic contact layer consisting of n+ amorphous silicon (n+a-Si:H). In addition, the active layer may include an oxide semiconductor. The oxide semiconductor may include an amorphous oxide including at least one selected from the group consisting of indium (In), zinc (Zn), gallium (Ga), tin (Sn) and hafnium (Hf). More particularly, the oxide semiconductor may consist of an amorphous oxide including indium (In), zinc (Zn) and gallium (Ga), or an amorphous oxide including indium (In), zinc (Zn) and hafnium (Hf). The oxide semiconductor may include an oxide such as indium zinc oxide (InZnO), indium gallium oxide (InGaO), indium tin oxide (InSnO), zinc tin oxide (ZnSnO), gallium tin oxide (GaSnO) and gallium zinc oxide (GaZnO). For example, the active layer may include indium gallium zinc oxide (IGZO).

A data pattern may be disposed on the first insulation layer 120 on which the active layer is disposed. The data pattern may include a metal, an alloy, a conductive metal oxide, a transparent conductive material, etc. For example, the data pattern may be formed using aluminum (Al), an alloy containing aluminum, aluminum nitride (AlNx), silver (Ag), an alloy containing silver, tungsten (W), tungsten nitride (WNx), copper (Cu), an alloy containing copper, nickel (Ni), an alloy containing nickel, chrome (Cr), chrome nitride (CrNx), molybdenum (Mo), an alloy containing molybdenum, titanium (Ti), titanium nitride (TiNx), platinum (Pt), tantalum (Ta), tantalum nitride (TaNx), neodymium (Nd), scandium (Sc), strontium ruthenium oxide (SRO), zinc oxide (ZnOx), indium tin oxide (ITO), tin oxide (SnOx), indium oxide (InOx), gallium oxide (GaOx), indium zinc oxide (IZO), etc. These may be used alone or in combination. In an exemplary embodiment of the inventive concept, the data pattern may have a single layer structure or a multi layer structure, which may include a metal film, an alloy film, a metal nitride film, a conductive metal oxide film and/or a transparent conductive film.

The data pattern may include a signal line to transmit signals for driving the pixel and a storage electrode. For example, the data pattern may include a first source electrode SE1, a second source electrode SE2 (of TFT2), a first drain electrode DE1, a second drain electrode DE2 (of TFT2), the first data line DL1 and the second data line DL2.

The first source electrode SE1 may be overlapped with the first active pattern ACT1, and be electrically connected to the first data line DL1. The second source electrode SE2 may be overlapped with the second active pattern ACT2, and be electrically connected to the second data line DL2.

The first drain electrode DE1 may be overlapped with the first active pattern ACT1, and be spaced apart from the first source electrode SE1. The second drain electrode DE2 may be overlapped with the second active pattern ACT2, and be spaced apart from the second source electrode SE2.

The first data line DL1 and the second data line DL2 may be extended along a second direction D2 which crosses the first direction D1. The first data line DL1 and the second data line DL2 may be spaced apart from each other in the first direction D1.

The first thin film transistor TFT1 may include the first gate electrode GE1, the first active pattern ACT1, the first source electrode SE1 and the first drain electrode DEL The second thin film transistor TFT2 may include the second gate electrode GE2, the second active pattern ACT2, the second source electrode SE2 and the second drain electrode DE2.

The second insulation layer 130 may be disposed on the first insulation layer 120 on which the first and second thin film transistor TFT1 and TFT2 are disposed. The second insulation layer 130 may have a single-layered structure or a multi-layered structure including at least two insulation films. The second insulation layer 130 may be formed using an organic material. For example, the second insulation layer 130 may include a photoresist, an acryl-based resin, a polyimide-based resin, a polyamide-based resin, a siloxane-based resin, etc. These may be used alone or in combination.

In addition, the second insulation layer 130 may include an inorganic material. For example, the second insulation layer 130 may be formed using silicon oxide, silicon nitride, silicon oxynitride, silicon oxycarbide, aluminum, magnesium, zinc, hafnium, zirconium, titanium, tantalum, aluminum oxide, titanium oxide, tantalum oxide, magnesium oxide, zinc oxide, hafnium oxide, zirconium oxide, titanium oxide, etc. These may be used alone or in a mixture.

The high sub-pixel electrode HPX and the low sub-pixel electrode LPX may be disposed on the second insulation layer 130. The high sub-pixel electrode HPX may be electrically connected to the first drain electrode DE1 though a contact hole which is formed through the second insulation layer 130. The low sub-pixel electrode LPX may be electrically connected to the second drain electrode DE2 though a contact hole which is formed through the second insulation layer 130. In a plan view, the high sub-pixel electrode HPX and the low sub-pixel electrode LPX may be spaced apart from each other. The first gate line GL1 may be disposed between the high sub-pixel electrode HPX and the low sub-pixel electrode LPX. The high sub-pixel electrode HPX and the low sub-pixel electrode LPX may be arranged in the second direction D2. In an exemplary embodiment of the inventive concept, the high sub-pixel electrode HPX and the low sub-pixel electrode LPX may have substantially the same size. In an exemplary embodiment of the inventive concept, the high sub-pixel electrode HPX and the low sub-pixel electrode LPX may have different size from each other.

Voltages applied to the high sub-pixel electrode HPX and the low sub-pixel electrode LPX may be different from each other. For example, a first pixel voltage may be applied to the high sub-pixel electrode HPX through the first data line DL1, and a second pixel voltage may be applied to the low sub-pixel electrode LPX through the second data line DL2.

The high sub-pixel electrode HPX and the low sub-pixel electrode LPX may include a transparent conductive material. For example, the high sub-pixel electrode HPX and the low sub-pixel electrode LPX may include indium tin oxide (ITO) or indium zinc oxide (IZO). In addition, the high sub-pixel electrode HPX and the low sub-pixel electrode LPX may include titanium (Ti) or a molybdenum titanium alloy (MoTi).

The first alignment layer 140 may be disposed on the second insulation layer 130 on which the high sub-pixel electrode HPX and the low sub-pixel electrode LPX are disposed. For example, a photoreactive polymer of a cinnamate group and a blend of polymers of a polyimide group are spread and hardened on the high sub-pixel electrode HPX and the low sub-pixel electrode LPX, so that the first alignment layer 140 may be formed.

The first substrate 100 may further include a first polarizer.

The second substrate 200 may disposed to face the first substrate 100. The second substrate 200 may include a second base substrate 210, a light blocking pattern BM, a color filter CF, an over-coating layer 220, a common electrode CE and a second alignment layer 230.

The second base substrate 210 may include a transparent insulation substrate. For example, the second base substrate 210 may include a glass substrate, a quartz substrate, a transparent resin substrate, etc. Examples of the transparent resin substrate for the second base substrate 210 may include a polyimide-based resin, an acryl-based resin, a polyacrylate-based resin, a polycarbonate-based resin, a polyether-based resin, a sulfonic acid containing resin, a polyethyleneterephthalate-based resin, etc. In addition, the second base substrate 210 may include a flexible material, so that the display panel 10 may be a flexible display panel or a curved display panel.

The light blocking pattern BM may be disposed on the second base substrate 210. The light blocking pattern BM may include an organic material or an inorganic material which can block light. For example, the light blocking pattern BM may be a black matrix pattern including chrome oxide. The light blocking pattern BM may be disposed any place where light is to be blocked. For example, the light blocking pattern BM may disposed to overlap the first and second thin film transistors TFT1 and TFT2, and the first gate line GL1. Accordingly, the light blocking pattern BM disposed in the middle of the pixel may divide the pixel into two portions along the second direction D2.

The color filter CF may be disposed on the second base substrate 210 on which the light blocking pattern BM is formed. The color filter CF may be disposed on the light blocking pattern BM and the second base substrate 210. The color filter CF supplies colors to light passing through the liquid crystal layer 300. The color filter CF may include a red color filter, a green color filter and a blue color filter. The color filter CF corresponds to a pixel area. Color filters adjacent to each other may have different colors. The color filter CF may be overlapped with an adjacent color filter CF in a boundary of the pixel area, or the color filter CF may be spaced apart from an adjacent color filter CF in the boundary of the pixel area. The color filter CF may overlap the high sub-pixel electrode HPX and the low sub-pixel electrode LPX. The high sub-pixel electrode HPX and the low sub-pixel electrode LPX in one pixel may overlap a color filter CF having the same color.

The over-coating layer 220 may be disposed on the first to third color filters CF (e.g., red, green and blue) and the light blocking pattern BM. The over-coating layer 220 may flatten the color filters CF, protect the color filters CF, and insulate the color filters CF. The over-coating layer 220 may include an acrylic-epoxy material.

The common electrode CE may include a transparent conductive material. For example, the common electrode CE may include indium tin oxide (ITO) or indium zinc oxide (IZO). In addition, the common electrode CE may include titanium (Ti) or molybdenum titanium alloy (MoTi).

The second alignment layer 230 may be disposed on the common electrode CE. For example, a photoreactive polymer of a cinnamate group and a blend of polymers of a polyimide group are spread and hardened on the common electrode CE, so that the second alignment layer 230 may be formed.

The second substrate 200 may further include a second polarizer, and a polarizing axis of the second polarizer may be substantially perpendicular to that of the first polarizer.

The liquid crystal layer 300 may be disposed between the first substrate 100 and the second substrate 200. The liquid crystal layer 300 may include liquid crystal molecules having optical anisotropy. The liquid crystal molecules may be driven by an electric field, so that an image may be displayed by passing or blocking light through the liquid crystal layer 300. The liquid crystal molecules of the liquid crystal layer 300 may be driven with a vertical alignment (VA) mode by the first and second alignment layers 140 and 230, so that long axes of the liquid crystal molecules are substantially perpendicular to the first and second substrates 100 and 200 when the electric field is not applied.

FIG. 4 is a graph illustrating a gamma curve which is used to drive a display panel included in a display apparatus according to an exemplary embodiment of the inventive concept.

Referring to FIG. 4, a luminance of an image based on a first gamma curve GH may be equal to or higher than a luminance of an image based on a reference gamma curve GN, and a luminance of an image based on a second gamma curve GL may be equal to or lower than the luminance of the image based on the reference gamma curve GN. A composite gamma curve of the first and second gamma curves GH and GL may be substantially the same as the reference gamma curve GN.

A high sub-pixel HPX operating based on the first gamma curve GH may display an image having a luminance that is higher than a target luminance, and a low sub-pixel LPX operating based on the second gamma curve GL may display an image having a luminance that is lower than the target luminance. When the high sub-pixel HPX operates based on the first gamma curve GH, and when the low sub-pixel LPX operates based on the second gamma curve GL, an image having the target luminance may be displayed by the high sub-pixel HPX and the low sub-pixel LPX by combining the image having the lower luminance with the image having the higher luminance. A driving scheme based on the first and second gamma curves GH and GL may be referred to as a spatial gamma mixing (SGM) scheme.

Figure 5A:
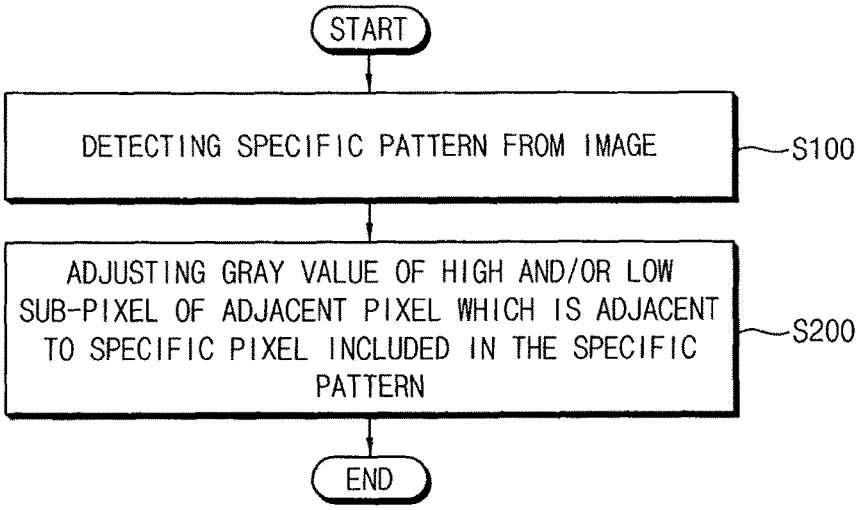
FIG. 5A is a flow chart illustrating a method of driving a display panel according to an exemplary embodiment of the inventive concept.
Figure 5B:
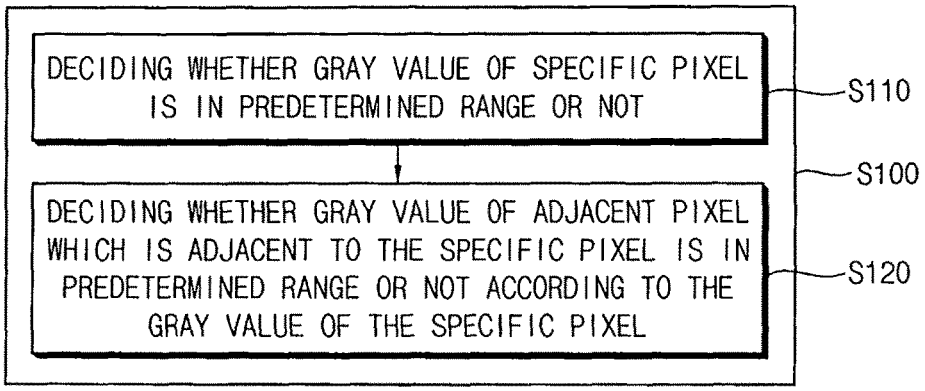
FIG. 5B is flow chart illustrating (S100) of FIG. 5A in detail.

FIG. 5A is a flow chart illustrating a method of driving a display panel according to an exemplary embodiment of the inventive concept. FIG. 5B is flow chart illustrating (S100) of FIG. 5A in detail.

Referring to FIGS. 5A and 5B, a method of driving a display panel may include detecting a specific pattern from an image (step S100), and changing a gray value of a high or low sub-pixel of an adjacent pixel which is adjacent to a specific pixel which is included in the specific pattern (step S200). Such a change may adjust the intensity of an image displayed at the adjacent pixel.

The detecting (step S100) may include deciding whether a gray value of the specific pixel is in a predetermined range or not (step S110), and deciding whether a gray value of the adjacent pixel is in a predetermined range or not in accordance with the gray value of the specific pixel (step S120).

In (step S110), it may be decided whether the gray value of the specific pixel is in the predetermined range or not. For example, when the specific pattern is text, the predetermined range may be a gray value range corresponding to white or black configured to display the text.

In (step S120), it may be decided whether a gray value of the adjacent pixel is in a predetermined range or not. The adjacent pixel is disposed adjacent to the specific pixel, which is included in the specific pattern, in a direction in which a data line is extended. The predetermined range may be determined according to a gray value of the specific pixel. For example, when the gray value of the specific pixel is a white gray value, it may be decided whether the gray value of the adjacent pixel is in a gray value range which is respectively closer to black or not. When the gray value of the specific pixel is a black gray value, it may be decided whether the gray value of the adjacent pixel is in a gray value range which is respectively closer to white or not.

In an exemplary embodiment of the inventive concept, in (step S100), the specific pattern may be detected by deciding whether a difference between gray values of continuous pixels is greater than about 50% of a total gray value range or not.

In (step S200), the gray value of the high and/or low sub-pixel of the adjacent pixel determined through the detecting (step S100) may be changed. For example, when the gray value of the specific pixel is the black gray value, a gray value of one of the high and low sub-pixel of the adjacent pixel, which is closer to the specific pixel in a direction in which the data line is extended (refer to D2 of FIG. 3A), may be changed to a brighter gray value. When the gray value of the specific pixel is the white gray value, a gray value of one of the high and low sub-pixel of the adjacent pixel, which is closer to the specific pixel in the direction in which the data line is extended, may be changed to a darker gray value.

Figure 6A:
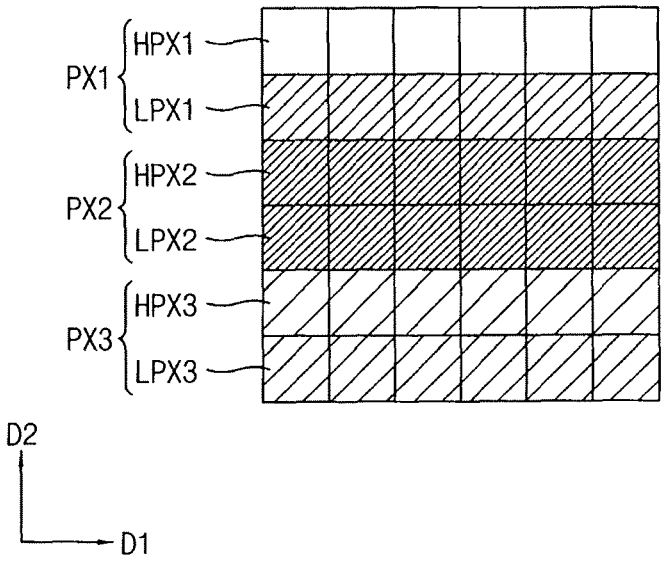
FIGS. 6A and 6B are plan views illustrating a portion of a display panel to explain effects of a method of driving a display panel according to an exemplary embodiment of the inventive concept.
Figure 6B:
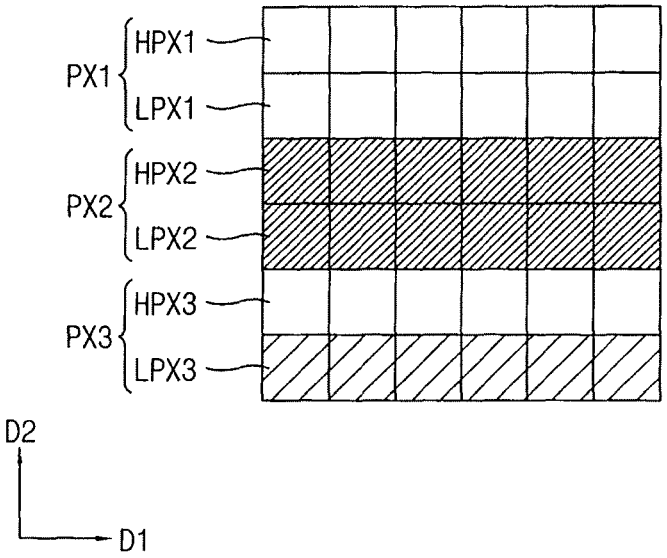

FIGS. 6A and 6B are plan views illustrating a portion of a display panel to explain effects of a method of driving a display panel according to an exemplary embodiment of the inventive concept.

Referring to FIG. 6A, the display panel 10 may include a plurality of pixels which are arranged in a matrix form. In FIG. 6A, pixels having a 3*6 matrix form are illustrated. Thus, six pixels are arranged in a first direction D1, and a first pixel PX1, a second pixel PX2, and a third pixel PX3 are arranged in a second direction D2 which crosses the first direction D1.

The first pixel PX1 may include a first high sub-pixel HPX1 and a first low sub-pixel LPX1 adjacent to the first high sub-pixel HPX1 in the second direction D2. The second pixel PX2 may include a second high sub-pixel HPX2 and a second low sub-pixel LPX2 adjacent to the second high sub-pixel HPX2 in the second direction D2. The third pixel PX3 may include a third high sub-pixel HPX3 and a third low sub-pixel LPX3 adjacent to the third high sub-pixel HPX3 in the second direction D2.

Gray values may be applied to the high and low sub-pixels HPX and LPX of the pixels PX to display an image on the display panel 10. Here, high gray values may be applied to the first to third high sub-pixels HPX1, HPX2 and HPX3 based on first gamma data. In addition, low gray values may be applied to the first to third low sub-pixels LPX1, LPX2 and LPX3 based on second gamma data.

When a black gray value is applied to the second pixel PX2, and a white or gray gray value is applied to the first and third pixels PX1 and PX3, the second pixel PX2 is a specific pixel of a specific pattern. The first low sub-pixel LPX1 of the first pixel PX1 and the third high sub-pixel HPX3 of the third pixel PX3 which are adjacent to the second pixel PX2 in the second direction D2 are adjacent pixels. The first low sub-pixel LPX1 of the first pixel PX1 and the third high sub-pixel HPX3 of the third pixel PX3 which are the adjacent pixels may display a darker gray level than their intended gray levels due to the effect of the second pixel PX2 which is the specific pixel and has the black gray value.

Referring to FIG. 6B, here, according to the driving method of the inventive concept, gray values of the first low sub-pixel LPX1 of the first pixel PX1 and the third high sub-pixel HPX3 of the third pixel PX3 which are the adjacent pixels may be changed to brighter value, so that a fuzz at a boundary of the specific pattern may be reduced. Accordingly, a display quality of the display panel 10 may be increased.

Here, gray values of the first high sub-pixel HPX1 of the first pixel PX1 and the third low sub-pixel LPX3 of the third pixel PX3 may be maintained without change. Thus, a high sub-pixel HPX and a low sub-pixel LPX in one pixel PX may be individually controlled by using first and second thin film transistors (refer to TFT1 and TFT2 of FIG. 3A) which are respectively connected to the high and low sub-pixels HPX and LPX in the one pixel PX.

Figure 6C:
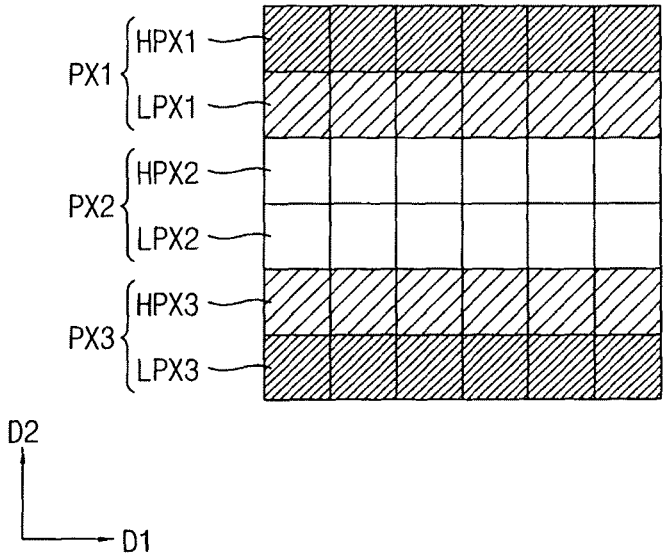
FIGS. 6C and 6D are plan views illustrating a portion of a display panel to explain effects of a method of driving a display panel according to an exemplary embodiment of the inventive concept.
Figure 6D:
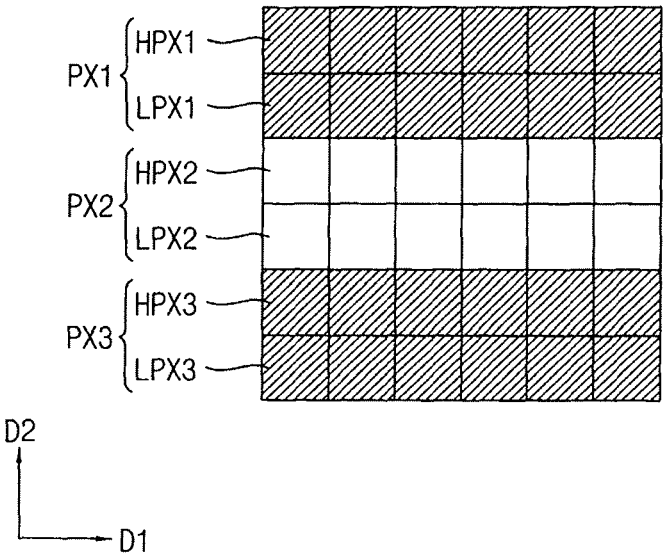

FIGS. 6C and 6D are plan views illustrating a portion of a display panel to explain effects of a method of driving a display panel according to an exemplary embodiment of the inventive concept.

Referring to FIG. 6C, the display panel 10 may include a plurality of pixels which are arranged in a matrix form. In FIG. 6C, pixels having a 3*6 matrix form are illustrated. Thus, six pixels are arranged in a first direction D1, and a first pixel PX1, a second pixel PX2, and a third pixel PX3 are arranged in a second direction D2 which crosses the first direction D1.

The first pixel PX1 may include a first high sub-pixel HPX1 and a first low sub-pixel LPX1 adjacent to the first high sub-pixel HPX1 in the second direction D2. The second pixel PX2 may include a second high sub-pixel HPX2 and a second low sub-pixel LPX2 adjacent to the second high sub-pixel HPX2 in the second direction D2. The third pixel PX3 may include a third high sub-pixel HPX3 and a third low sub-pixel LPX3 adjacent to the third high sub-pixel HPX3 in the second direction D2.

Gray values may be applied to the high and low sub-pixels HPX and LPX of the pixels PX to display an image on the display panel 10. Here, high gray values may be applied to the first to third high sub-pixels HPX1, HPX2 and HPX3 based on first gamma data. In addition, low gray values may be applied to the first to third low sub-pixels LPX1, LPX2 and LPX3 based on second gamma data.

When a white gray value is applied to the second pixel PX2, and a black gray value is applied to the first and third pixels PX1 and PX3, the second pixel PX2 is a specific pixel of a specific pattern. The first low sub-pixel LPX1 of the first pixel PX1 and the third high sub-pixel HPX3 of the third pixel PX3 which are adjacent to the second pixel PX2 in the second direction D2 are adjacent pixels. The first low sub-pixel LPX1 of the first pixel PX1 and the third high sub-pixel HPX3 of the third pixel PX3 which are the adjacent pixels may display a lighter gray level than their intended gray levels due to the effect of the second pixel PX2 which is the specific pixel and has the white gray value.

Referring to FIG. 6D, here, according to the driving method of the inventive concept, gray values of the first low sub-pixel LPX1 of the first pixel PX1 and the third high sub-pixel HPX3 of the third pixel PX3 which are the adjacent pixels may be changed to a darker value, so that a fuzz at a boundary of the specific pattern may be reduced. Accordingly, a display quality of the display panel 10 may be increased.

Here, gray values of the first high sub-pixel HPX1 of the first pixel PX1 and the third low sub-pixel LPX3 of the third pixel PX3 may be maintained without change. Thus, a high sub-pixel HPX and a low sub-pixel LPX in one pixel PX may be individually controlled by using first and second thin film transistors (refer to TFT1 and TFT2 of FIG. 3A) which are respectively connected to the high and low sub-pixels HPX and LPX in the one pixel PX.

Figure 7A:
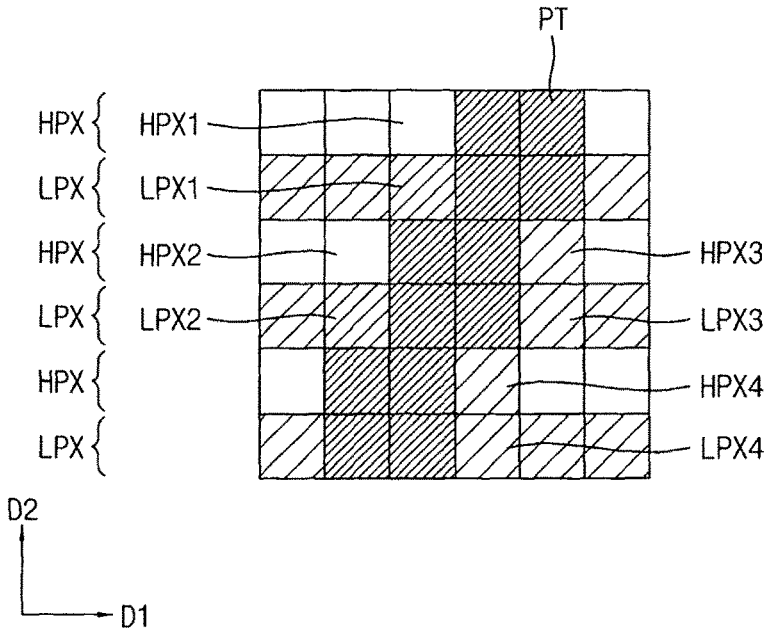
FIGS. 7A and 7B are plan views illustrating a portion of a display panel to explain effects of a method of driving a display panel according to an exemplary embodiment of the inventive concept.
Figure 7B:
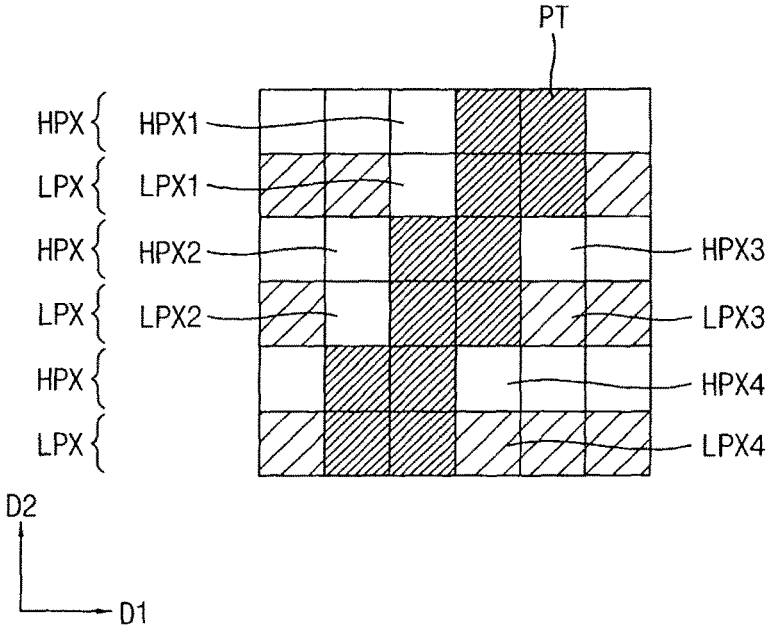

FIGS. 7A and 7B are plan views illustrating a portion of a display panel to explain effects of a method of driving a display panel according to an exemplary embodiment of the inventive concept.

Referring to FIG. 7A, the display panel 10 may include a plurality of pixels which are arranged in a matrix form. In FIG. 7A, pixels having a 3*6 matrix form are illustrated. Thus, six pixels are arranged in a first direction D1, and three pixels are arranged in a second direction D2 which crosses the first direction D1.

Each of the pixels may include a high sub-pixel HPX and a low sub-pixel LPX which is adjacent to the high sub-pixel HPX in the second direction D2.

Gray values may be applied to the high and low sub-pixels HPX and LPX of the pixels PX to display an image on the display panel 10. Here, high gray values may be applied to the high sub-pixels HPX based on first gamma data. In addition, low gray values may be applied to the low sub-pixels LPX based on second gamma data.

When a black gray value which corresponds to a specific pattern PT is applied to specific pixels, and a white or gray gray value is applied to pixels other than the specific pixel, a first low sub-pixel LPX1 of a first sub-pixel, a second low sub-pixel LPX2 of a second low sub-pixel, a third high sub-pixel HPX3 of a third pixel and a fourth high sub-pixel HPX4 of a fourth pixel which are adjacent to the specific pixel in the second direction D2 may display darker gray levels than their intended gray levels due to the effect of the black gray value of the specific pixels.

Referring to FIG. 7B, here, according to the driving method of the inventive concept, gray values of the first low sub-pixel LPX1, the second low sub-pixel LPX2, the third high sub-pixel HPX3 and the fourth high sub-pixel HPX4 which are the adjacent pixels may be changed to brighter values, so that a fuzz at a boundary of the specific pattern PT may be reduced. Accordingly, a display quality of the display panel 10 may be increased.

Here, gray values of a first high sub-pixel HPX1 of the first pixel and a second high sub-pixel HPX2 of the second pixel, a third low sub-pixel LPX3 of the third pixel and a forth low sub-pixel LPX4 of the fourth pixel may be maintained without change. Thus, a high sub-pixel HPX and a low sub-pixel LPX in one pixel PX may be individually controlled by using first and second thin film transistors (refer to TFT1 and TFT2 of FIG. 3A) which are respectively connected to the high and low sub-pixels HPX and LPX in the one pixel PX.

Figure 8:
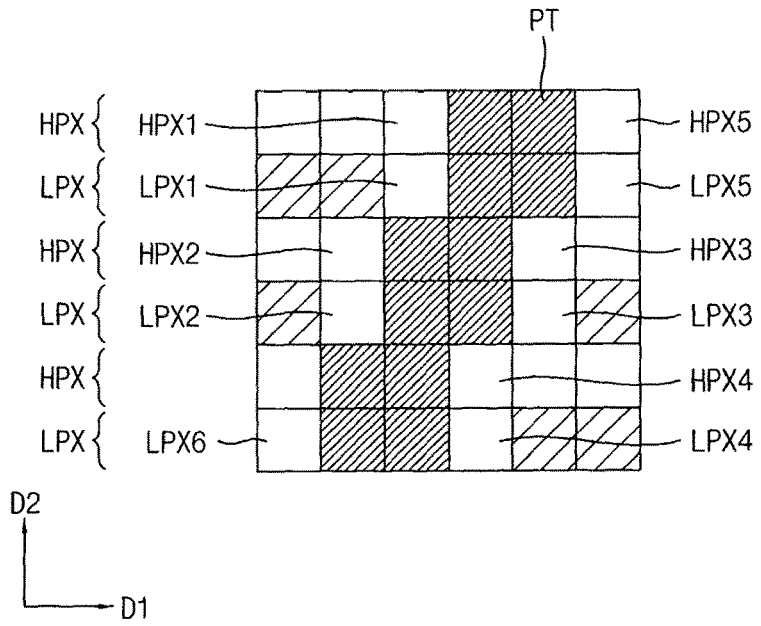
FIG. 8 is a plan view illustrating a portion of a display panel to explain effects of a method of driving a display panel according to an exemplary embodiment of the inventive concept.

FIG. 8 is a plan view illustrating a portion of a display panel to explain effects of a method of driving a display panel according to an exemplary embodiment of the inventive concept.

Referring to FIG. 8, the display panel 10 may include a plurality of pixels which are arranged in a matrix form. In FIG. 8, pixels having a 3*6 matrix form are illustrated. Thus, six pixels are arranged in a first direction D1, and three pixels are arranged in a second direction D2 which crosses the first direction D1.

Each of the pixels may include a high sub-pixel HPX and a low sub-pixel LPX which is adjacent to the high sub-pixel HPX in the second direction D2.

Gray values may be applied to the high and low sub-pixels HPX and LPX of the pixels PX to display an image on the display panel 10. Here, high gray values may be applied to the high sub-pixels HPX based on first gamma data. In addition, low gray values may be applied to the low sub-pixels LPX based on second gamma data.

When a black gray value which corresponds to a specific pattern PT is applied to specific pixels, and a white or gray gray value is applied to pixels other than the specific pixel, adjacent sub-pixels which are adjacent to the specific pixel in the second direction D2 may display a darker gray level than their intended gray levels due to the effect of the black gray value of the specific pixels.

Here, according to the driving method of the inventive concept, gray values of the first low sub-pixel LPX1, the second low sub-pixel LPX2, the third high sub-pixel HPX3 and the fourth high sub-pixel HPX4 which are the adjacent pixels may be changed to a brighter value, so that a fuzz at a boundary of the specific pattern PT may be reduced. Accordingly, a display quality of the display panel 10 may be increased.

In addition, a third low sub-pixel LPX3 of the third pixel, a fourth low-sub-pixel LPX4 of the fourth pixel, a fifth low-sub-pixel LPX5 of the fifth pixel and a sixth low sub-pixel LPX6 of the sixth pixel which are adjacent pixels adjacent to the specific pixels in the first direction D1 may respectively display a darker gray value. According to the driving method of the inventive concept, the gray values of the third low sub-pixel LPX3, the fourth low-sub-pixel LPX4, the fifth low-sub-pixel LPX5 and the sixth low sub-pixel LPX6 which are adjacent to the specific pixels in the first direction D1 may be changed to brighter gray values. Thus, the gray value of the high or low sub-pixels HPX or LPX which are the adjacent pixels may be changed, so that a fuzz at a boundary of the specific pattern PT may be reduced. Accordingly, a display quality of the display panel 10 may be increased.

Here, gray values of a first high sub-pixel HPX1 of the first pixel, a second high sub-pixel HPX2 of the second pixel, and a fifth high sub-pixel HPX5 of the fifth pixel may be maintained without change. Thus, a high sub-pixel HPX and a low sub-pixel LPX in one pixel PX may be individually controlled by using first and second thin film transistors (refer to TFT1 and TFT2 of FIG. 3A) which are respectively connected to the high and low sub-pixels HPX and LPX in the one pixel PX.

Figure 9A:
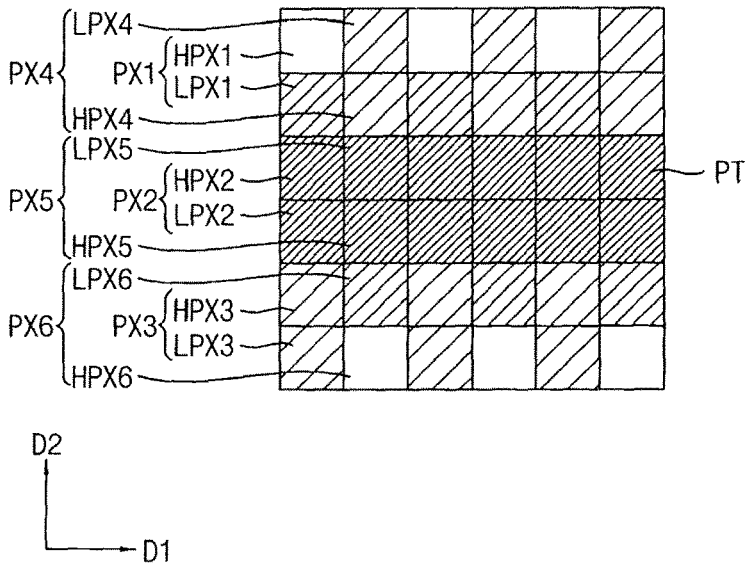
FIGS. 9A and 9B are plan views illustrating a portion of a display panel to explain effects of a method of driving a display panel according to an exemplary embodiment of the inventive concept.
Figure 9B:
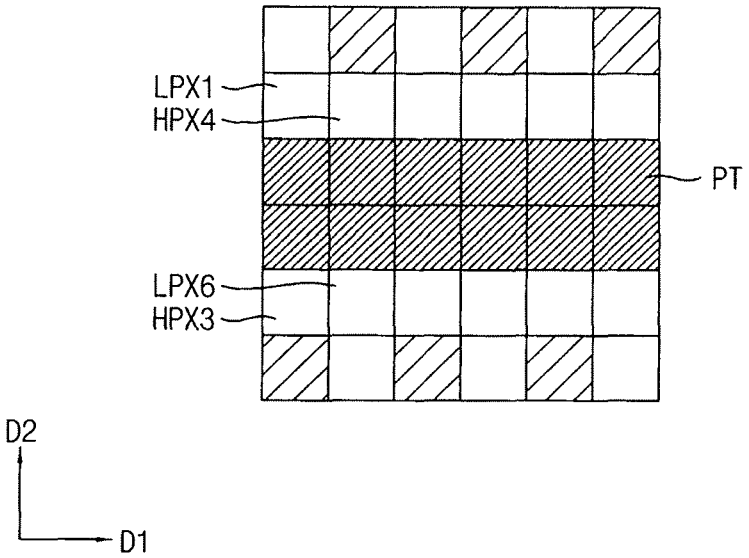

FIGS. 9A and 9B are plan views illustrating a portion of a display panel to explain effects of a method of driving a display panel according to an exemplary embodiment of the inventive concept.

Referring to FIG. 9A, the display panel 10 may include a plurality of pixels which are arranged in a matrix form. In FIG. 9A, pixels having a 3*6 matrix form are illustrated. Thus, six pixels are arranged in a first direction D1, and a first pixel PX1, a second pixel PX2 and a third pixel PX3 are arranged in a second direction D2 which crosses the first direction D1. A fourth pixel PX4, a fifth pixel PX5 and a sixth pixel PX6 are arranged in the second direction D2 and adjacent to the first to third pixels PX1 to PX3 in the first direction D1, respectively.

The first pixel PX1 may include a first high sub-pixel HPX1 and a first low sub-pixel LPX1 which is adjacent to the first high sub-pixel HPX1 in the second direction D2. The second pixel PX2 may include a second high sub-pixel HPX2 and a second low sub-pixel LPX2 which is adjacent to the second high sub-pixel HPX2 in the second direction D2. The third pixel PX3 may include a third high sub-pixel HPX3 and a third low sub-pixel LPX3 which is adjacent to the third high sub-pixel HPX3 in the second direction D2. The fourth pixel PX4 may include a fourth high sub-pixel HPX4 and a fourth low sub-pixel LPX4 which is adjacent to the fourth high sub-pixel HPX4 in the second direction D2. The fifth pixel PX5 may include a fifth high sub-pixel HPX5 and a fifth low sub-pixel LPX5 which is adjacent to the fifth high sub-pixel HPX5 in the second direction D2. The sixth pixel PX6 may include a sixth high sub-pixel HPX6 and a sixth low sub-pixel LPX6 which is adjacent to the sixth high sub-pixel HPX6 in the second direction D2. Thus, the high sub-pixels HPX and the low sub-pixels LPX are alternately disposed in the first and the second directions D1 and D2.

Gray values may be applied to the high and low sub-pixels HPX and LPX to display an image on the display panel 10. Here, high gray values may be applied to the first to sixth high sub-pixels HPX1 to HPX6 based on first gamma data. In addition, low gray values may be applied to the first to third low sub-pixels LPX1 to LPX3 based on second gamma data.

When a black gray value is applied to the second pixel PX2 and the fifth pixel PX5, and a white or gray gray value is applied to the first, third, fourth and sixth pixels PX1, PX3, PX4 and PX6, the first low sub-pixel LPX1 of the first pixel PX1 and the third high sub-pixel HPX3 of the third pixel PX3, which are adjacent pixels adjacent to the second pixel PX2 corresponding to a specific pixel, which is included in a specific pattern, may display darker gray levels than their intended gray levels due to the effect of the black gray value of the specific pixel. In addition, the fourth high sub-pixel HPX4 of the fourth pixel PX4 and the sixth low sub-pixel LPX6 of the sixth pixel PX6 which are adjacent pixels adjacent to the fifth pixel PX5 corresponding to the specific pixel, which is included in the specific pattern, may display darker gray levels than their intended gray levels due to the effect of the black gray value of the specific pixel.

Referring to FIG. 9B, here, according to the driving method of the inventive concept, gray values of the first low sub-pixel LPX1, the third high sub-pixel HPX3, the fourth sub-pixel HPX4 and the sixth sub-pixel HPX6 which are the adjacent pixels may be changed to brighter values, so that a fuzz at a boundary of the specific pattern PT may be reduced. Accordingly, a display quality of the display panel 10 may be increased.

Here, gray values of the first high sub-pixel HPX1 and the third low sub-pixel LPX3, the fourth low sub-pixel LPX4 and the sixth high sub-pixel HPX6 may be maintained without change. Thus, a high sub-pixel HPX and a low sub-pixel LPX in one pixel PX may be individually controlled by using first and second thin film transistors (refer to TFT1 and TFT2 of FIG. 3A) which are respectively connected to the high and low sub-pixels HPX and LPX in the one pixel PX.

Figure 10A:
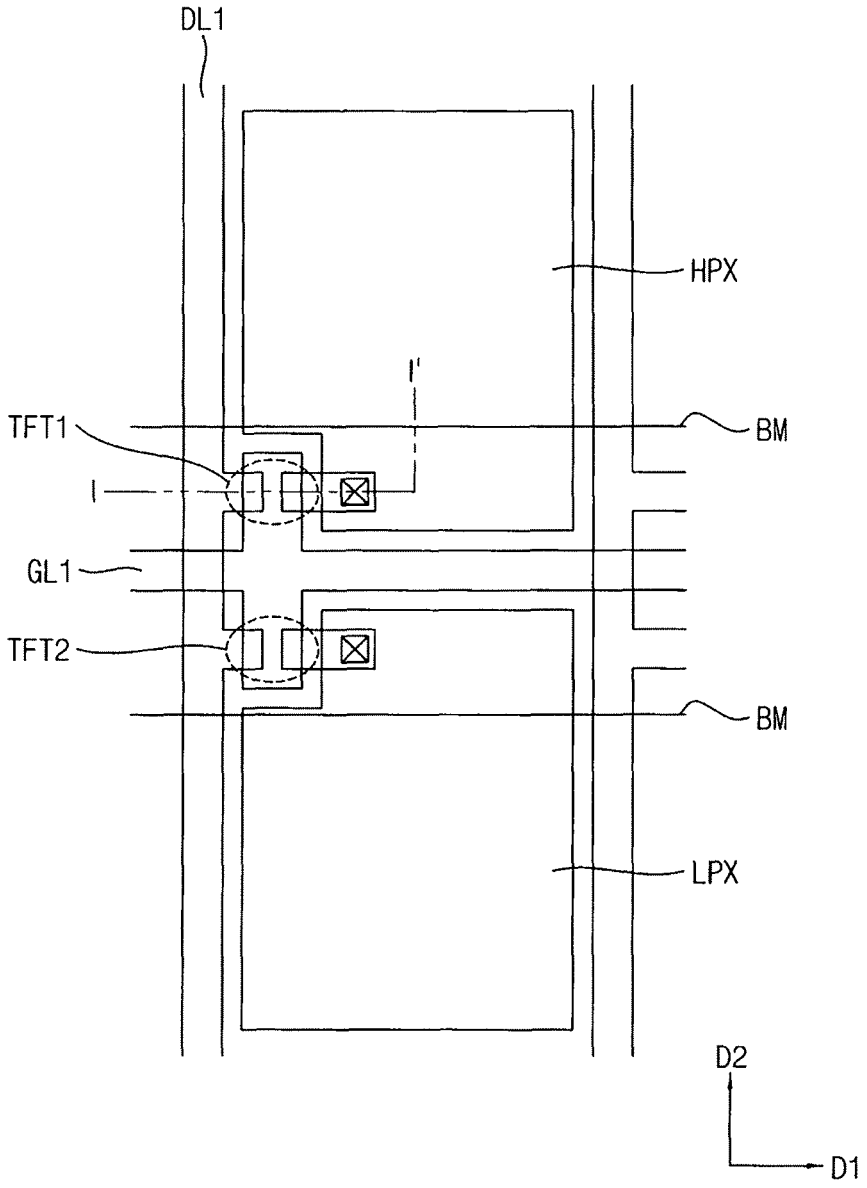
FIG. 10A is plan view illustrating one pixel of a display panel according to an exemplary embodiment of the inventive concept.
Figure 10B:
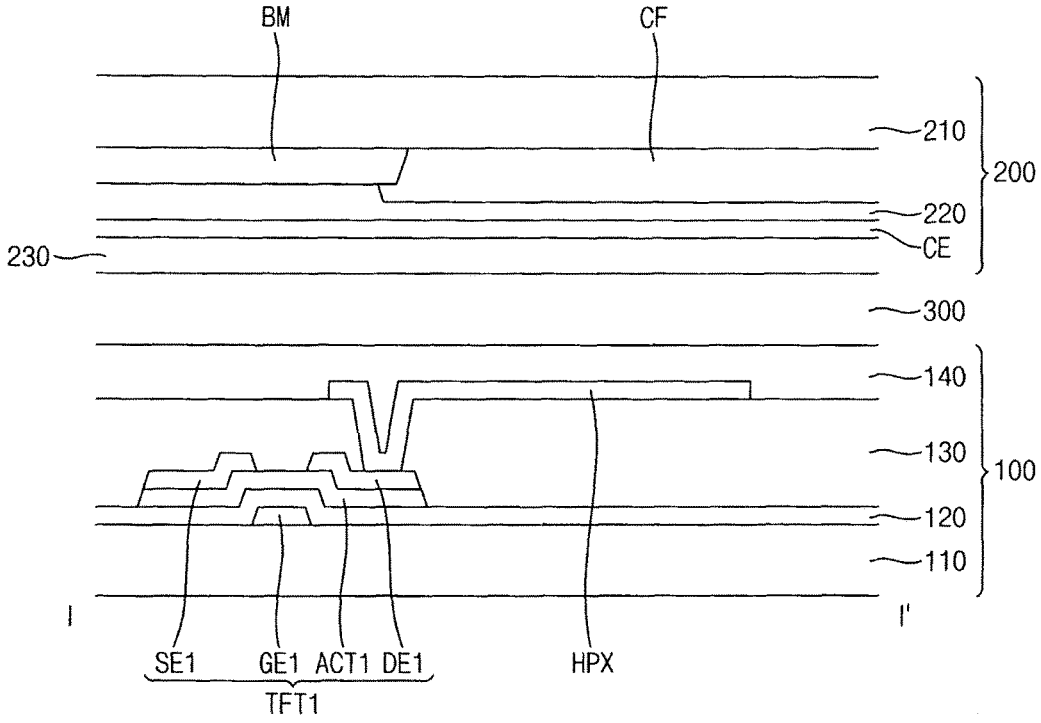
FIG. 10B is a cross-sectional view taken along a line II-II' of FIG. 10A.

FIG. 10A is plan view illustrating one pixel of a display panel according to an exemplary embodiment of the inventive concept. FIG. 10B is a cross-sectional view taken along a line II-II' of FIG. 10A.

Referring to FIGS. 10A and 10B, a display panel may include a first substrate 100, a second substrate 200 and a liquid crystal layer 300.

The first substrate 100 may include a first base substrate 110, a first thin film transistor TFT1, a second thin film transistor TFT2, a first gate line GL1, a first insulation layer 120, a first data line DL1, a second insulation layer 130, a high sub-pixel electrode HPX, a low sub-pixel electrode LPX, and a first alignment layer 140.

The first base substrate 110 may include a transparent insulation material. For example, the first base substrate 110 may include a glass substrate, a quartz substrate, a transparent resin substrate, etc. Examples of the transparent resin substrate for the first base substrate 110 may include a polyimide-based resin, an acryl-based resin, a polyacrylate-based resin, a polycarbonate-based resin, a polyether-based resin, a sulfonic acid containing resin, a polyethylene-terephthalate-based resin, etc. In addition, the first base substrate 110 may include a flexible material, so that the display panel may be a flexible display panel or a curved display panel.

A gate pattern may be disposed on the first base substrate 110. The gate pattern may include a metal, an alloy, a conductive metal oxide, a transparent conductive material, etc. For example, the gate pattern may be formed using aluminum (Al), an alloy containing aluminum, aluminum nitride (AlNx), silver (Ag), an alloy containing silver, tungsten (W), tungsten nitride (WNx), copper (Cu), an alloy containing copper, nickel (Ni), an alloy containing nickel, chrome (Cr), chrome nitride (CrNx), molybdenum (Mo), an alloy containing molybdenum, titanium (Ti), titanium nitride (TiNx), platinum (Pt), tantalum (Ta), tantalum nitride (TaNx), neodymium (Nd), scandium (Sc), strontium ruthenium oxide (SRO), zinc oxide (ZnOx), indium tin oxide (ITO), tin oxide (SnOx), indium oxide (InOx), gallium oxide (GaOx), indium zinc oxide (IZO), etc. These may be used alone or in combination. In an exemplary embodiment of the inventive concept, the gate pattern may have a single layer structure or a multi layer structure, which may include a metal film, an alloy film, a metal nitride film, a conductive metal oxide film and/or a transparent conductive film.

The gate pattern may include a signal line to transmit signals for driving the pixel and a storage electrode. For example, the gate pattern may include a first gate electrode GE1, a second gate electrode GE2 (of TFT2) and the first gate line GL1.

The first gate line GL1 may be extended along a first direction D1. The first gate line GL1 may be electrically connected to the first gate electrode GE1 and the second gate electrode GE2.

The first insulation layer 120 may be disposed on the first base substrate 110 on which the gate pattern is disposed. The first insulation layer 120 may be uniformly formed on the first base substrate 110 along a profile of the gate pattern. Here, the first insulation layer 120 may have a substantially small thickness, such that a stepped portion may be formed at a portion of the first insulation layer 120 adjacent to the gate pattern. The first insulation layer 120 may be formed using a silicon compound. For example, the first insulation layer 120 may be formed using silicon oxide, silicon nitride, silicon oxynitride, silicon oxycarbide, aluminum, magnesium, zinc, hafnium, zirconium, titanium, tantalum, aluminum oxide, titanium oxide, tantalum oxide, magnesium oxide, zinc oxide, hafnium oxide, zirconium oxide, titanium oxide, etc. These may be used alone or in a mixture.

An active layer including a first active pattern ACT1 and a second active pattern ACT2 (of TFT2) may be disposed on the first insulation layer 120. The first active pattern ACT1 may overlap the first gate electrode GE1. The second active pattern ACT2 may overlap the second gate electrode GE2. The active layer may include a semiconductor layer consisting of amorphous silicon (a-Si:H) and an ohmic contact layer consisting of an n+ amorphous silicon (n+a-Si:H). In addition, the active layer may include an oxide semiconductor. The oxide semiconductor may include an amorphous oxide including at least one selected from the group consisting of indium (In), zinc (Zn), gallium (Ga), tin (Sn) and hafnium (Hf). More particularly, the oxide semiconductor may consist of an amorphous oxide including indium (In), zinc (Zn) and gallium (Ga), or an amorphous oxide including indium (In), zinc (Zn) and hafnium (Hf). The oxide semiconductor may include an oxide such as indium zinc oxide (InZnO), indium gallium oxide (InGaO), indium tin oxide (InSnO), zinc tin oxide (ZnSnO), gallium tin oxide (GaSnO) and gallium zinc oxide (GaZnO). For example, the active layer may include indium gallium zinc oxide (IGZO).

A data pattern may be disposed on the first insulation layer 120 on which the active layer is disposed. The data pattern may include a metal, an alloy, a conductive metal oxide, a transparent conductive material, etc. For example, the data pattern may be formed using aluminum (Al), an alloy containing aluminum, aluminum nitride (AlNx), silver (Ag), an alloy containing silver, tungsten (W), tungsten nitride (WNx), copper (Cu), an alloy containing copper, nickel (Ni), an alloy containing nickel, chrome (Cr), chrome nitride (CrNx), molybdenum (Mo), an alloy containing molybdenum, titanium (Ti), titanium nitride (TiNx), platinum (Pt), tantalum (Ta), tantalum nitride (TaNx), neodymium (Nd), scandium (Sc), strontium ruthenium oxide (SRO), zinc oxide (ZnOx), indium tin oxide (no), tin oxide (SnOx), indium oxide (InOx), gallium oxide (GaOx), indium zinc oxide (IZO), etc. These may be used alone or in combination. In an exemplary embodiment of the inventive concept, the data pattern may have a single layer structure or a multi layer structure, which may include a metal film, an alloy film, a metal nitride film, a conductive metal oxide film and/or a transparent conductive film.

The data pattern may include a signal line to transmit signals for driving the pixel and a storage electrode. For example, the data pattern may include a first source electrode SE1, a first drain electrode DE1, a second source electrode SE2 (of TFT2), a second drain electrode DE2 (of TFT2) and the first data line DL1.

The first source electrode SE1 may be overlapped with the first active pattern ACT1, and be electrically connected to the first data line DL1. The second source electrode SE2 may be overlapped with the second active pattern ACT2, and be electrically connected to the first data line DL1.

The first drain electrode DE1 may be overlapped with the first active pattern ACT1, and be spaced apart from the first source electrode SE1. The second drain electrode DE2 may be overlapped with the second active pattern ACT2, and be spaced apart from the second source electrode SE2.

The first data line DL1 and the second data line DL2 may be extended along a second direction D2 which crosses the first direction D1.

The first thin film transistor TFT1 may include the first gate electrode GE1, the first active pattern ACT1, the first source electrode SE1 and the first drain electrode DE1.

The second thin film transistor TFT2 may include the second gate electrode GE2, the second active pattern ACT2, the second source electrode SE2 and the second drain electrode DE2.

The second insulation layer 130 may be disposed on the first insulation layer 120 on which the first and second thin film transistor TFT1 and TFT2 are disposed. The second insulation layer 130 may have a single-layered structure or a multi-layered structure including at least two insulation films. The second insulation layer 130 may be formed using an organic material. For example, the second insulation layer 130 may include a photoresist, an acryl-based resin, a polyimide-based resin, a polyamide-based resin, a siloxane-based resin, etc. These may be used alone or in combination. In addition, the second insulation layer 130 may include an inorganic material. For example, the second insulation layer 130 may be formed using silicon oxide, silicon nitride, silicon oxynitride, silicon oxycarbide, aluminum, magnesium, zinc, hafnium, zirconium, titanium, tantalum, aluminum oxide, titanium oxide, tantalum oxide, magnesium oxide, zinc oxide, hafnium oxide, zirconium oxide, titanium oxide, etc. These may be used alone or in a mixture.

The high sub-pixel electrode HPX and the low sub-pixel electrode LPX may be disposed on the second insulation layer 130. The high sub-pixel electrode HPX may be electrically connected to the first drain electrode DE1 though a contact hole which is formed through the second insulation layer 130. The low sub-pixel electrode LPX may be electrically connected to the second drain electrode DE2 though a contact hole which is formed through the second insulation layer 130. In a plan view, the high sub-pixel electrode HPX and the low sub-pixel electrode LPX may be spaced apart from each other. The first gate line GL1 may be disposed between the high sub-pixel electrode HPX and the low sub-pixel electrode LPX. The high sub-pixel electrode HPX and the low sub-pixel electrode LPX may be arranged in the second direction D2. In an exemplary embodiment of the inventive concept, the high sub-pixel electrode HPX and the low sub-pixel electrode LPX may have substantially the same size. In an exemplary embodiment of the inventive concept, the high sub-pixel electrode HPX and the low sub-pixel electrode LPX may have different size from each other.

Voltages applied to the high sub-pixel electrode HPX and the low sub-pixel electrode LPX may be different from each other. For example, a first pixel voltage may be applied to the high sub-pixel electrode HPX through the first data line DL1 during a first period, and a second pixel voltage may be applied to the low sub-pixel electrode LPX through the first data line DL1 during a second period.

The high sub-pixel electrode HPX and the low sub-pixel electrode LPX may include a transparent conductive material. For example, the high sub-pixel electrode HPX and the low sub-pixel electrode LPX may include indium tin oxide (ITO) or indium zinc oxide (IZO). In addition, the high sub-pixel electrode HPX and the low sub-pixel electrode LPX may include titanium (Ti) or a molybdenum titanium alloy (MoTi).

The first alignment layer 140 may be disposed on the second insulation layer 130 on which the high sub-pixel electrode HPX and the low sub-pixel electrode LPX are disposed. For example, a photoreactive polymer of a cinnamate group and a blend of polymers of a polyimide group are spread and hardened on the high sub-pixel electrode HPX and the low sub-pixel electrode LPX, so that the first alignment layer 140 may be formed.

The first substrate 100 may further include a first polarizer.

The second substrate 200 may disposed to face the first substrate 100. The second substrate 200 may include a second base substrate 210, a light blocking pattern BM, a color filter CF, an over-coating layer 220, a common electrode CE and a second alignment layer 230.

The second base substrate 210 may include a transparent insulation substrate. For example, the second base substrate 210 may include a glass substrate, a quartz substrate, a transparent resin substrate, etc. Examples of the transparent resin substrate for the second base substrate 210 may include a polyimide-based resin, an acryl-based resin, a polyacrylate-based resin, a polycarbonate-based resin, a polyether-based resin, a sulfonic acid containing resin, a polyethyleneterephthalate-based resin, etc. In addition, the second base substrate 210 may include a flexible material, so that the display panel may be a flexible display panel or a curved display panel.

The light blocking pattern BM may be disposed on the second base substrate 210. The light blocking pattern BM may include an organic material or an inorganic material which can block light. For example, the light blocking pattern BM may be a black matrix pattern including chrome oxide. The light blocking pattern BM may be disposed any place where light is to be blocked. For example, the light blocking pattern BM may disposed to overlap the first and second thin film transistors TFT1 and TFT2, and the first gate line GL1. Accordingly, the light blocking pattern BM disposed in the middle of the pixel may divide the pixel into two portions along the second direction D2.

The color filter CF may be disposed on the second base substrate 210 on which the light blocking pattern BM is formed. The color filter CF may be disposed on the light blocking pattern BM and the second base substrate 210. The color filter CF supplies colors to light passing through the liquid crystal layer 300. The color filter CF may include a red color filter, a green color filter and a blue color filter. The color filter CF corresponds to a pixel area. The color filters adjacent to each other may have different colors. The color filter CF may be overlapped with an adjacent color filter CF in a boundary of the pixel area, or the color filter CF may be spaced apart from an adjacent color filter CF in the boundary of the pixel area. The color filter CF may overlap the high sub-pixel electrode HPX and the low sub-pixel electrode LPX. The high sub-pixel electrode HPX and the low sub-pixel electrode LPX in one pixel may overlap a color filter CF having the same color.

The over-coating layer 220 may be disposed on the first to third color filters CF (e.g., red, green and blue) and the light blocking pattern BM. The over-coating layer 220 may flatten the color filters CF, protect the color filters CF, and insulate the color filters CF. The over-coating layer 220 may include an acrylic-epoxy material.

The common electrode CE may include a transparent conductive material. For example, the common electrode CE may include indium tin oxide (ITO) or indium zinc oxide (IZO). In addition, the common electrode CE may include titanium (Ti) or molybdenum titanium alloy (MoTi).

The second alignment layer 230 may be disposed on the common electrode CE. For example, a photoreactive polymer of a cinnamate group and a blend of polymers of a polyimide group are spread and hardened on the common electrode CE, so that the second alignment layer 230 may be formed.

The second substrate 200 may further include a second polarizer, and a polarizing axis of the second polarizer may be substantially perpendicular to that of the first polarizer.

The liquid crystal layer 300 may be disposed between the first substrate 100 and the second substrate 200. The liquid crystal layer 300 may include liquid crystal molecules having optical anisotropy. The liquid crystal molecules may be driven by an electric field, so that an image may be displayed by passing or blocking light through the liquid crystal layer 300. The liquid crystal molecules of the liquid crystal layer 300 may be driven with a vertical alignment (VA) mode by the first and second alignment layers 140 and 230, so that long axes of the liquid crystal molecules are substantially perpendicular to the first and second substrates 100 and 200 when the electric field is not applied.

Figure 11A:
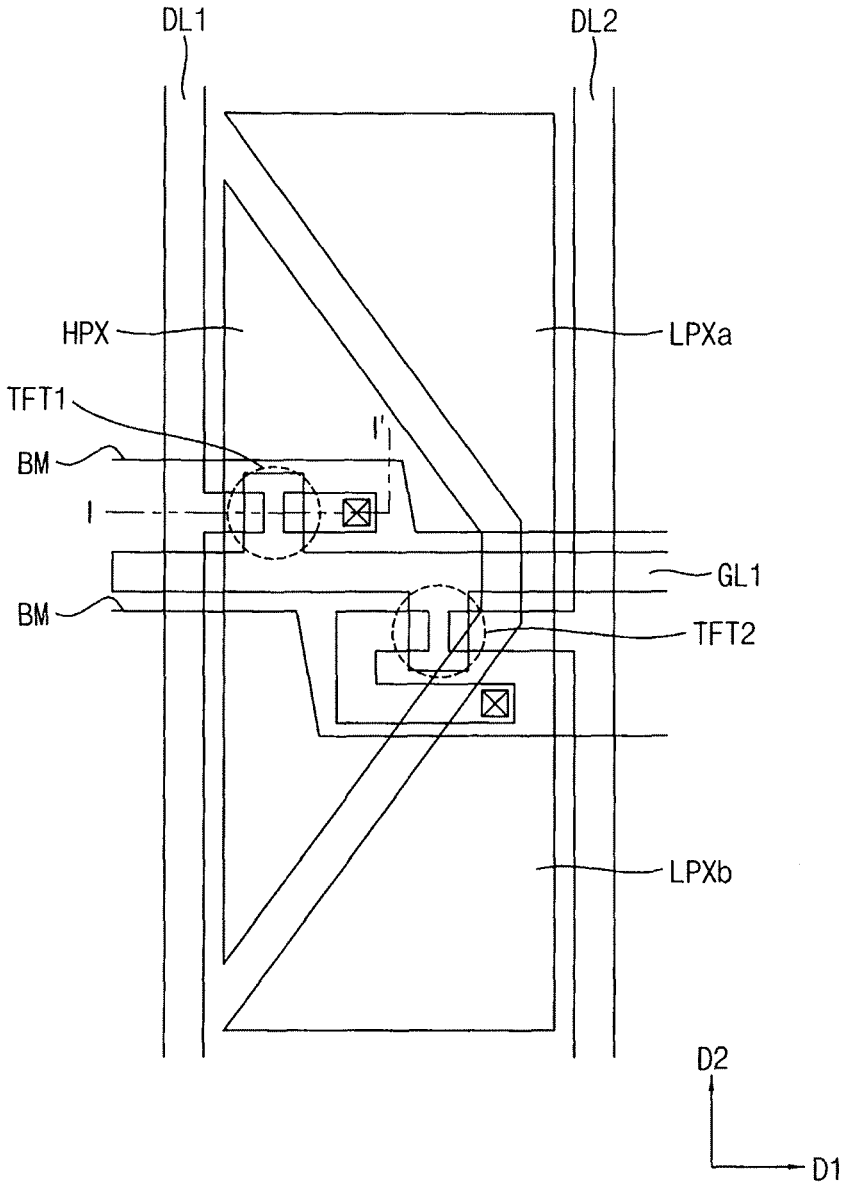
FIG. 11A is plan view illustrating one pixel of a display panel according to an exemplary embodiment of the inventive concept.
Figure 11B:
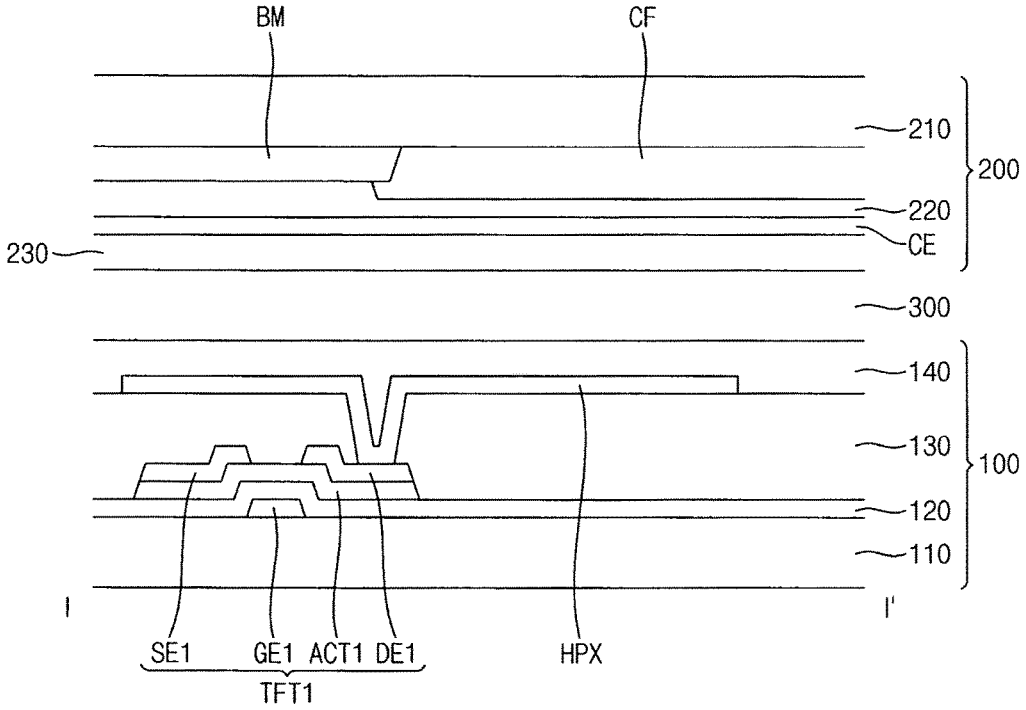
FIG. 11B is a cross-sectional view taken along a line I-I' of FIG. 11A.

FIG. 11A is plan view illustrating one pixel of a display panel according to an exemplary embodiment of the inventive concept. FIG. 11B is a cross-sectional view taken along a line I-I' of FIG. 11A.

Referring to FIGS. 11A and 11B, the display panel may include a first substrate 100, a second substrate 200 and a liquid crystal layer 300.

The first substrate 100 may include a first base substrate 110, a first thin film transistor TFT1, a second thin film transistor TFT2, a first gate line GL1, a first insulation layer 120, a first data line DL1, a second data line DL2, a second insulation layer 130, a high sub-pixel electrode HPX, a low sub-pixel electrode LPX, and a first alignment layer 140.

The first base substrate 110 may include a transparent insulation material. For example, the first base substrate 110 may include a glass substrate, a quartz substrate, a transparent resin substrate, etc. Examples of the transparent resin substrate for the first base substrate 110 may include a polyimide-based resin, an acryl-based resin, a polyacrylate-based resin, a polycarbonate-based resin, a polyether-based resin, a sulfonic acid containing resin, a polyethylene-terephthalate-based resin, etc. In addition, the first base substrate 110 may include a flexible material, so that the display panel may be a flexible display panel or a curved display panel.

A gate pattern may be disposed on the first base substrate 110. The gate pattern may include a metal, an alloy, a conductive metal oxide, a transparent conductive material, etc. For example, the gate pattern may be formed using aluminum (Al), an alloy containing aluminum, aluminum nitride (AlNx), silver (Ag), an alloy containing silver, tungsten (W), tungsten nitride (WNx), copper (Cu), an alloy containing copper, nickel (Ni), an alloy containing nickel, chrome (Cr), chrome nitride (CrNx), molybdenum (Mo), an alloy containing molybdenum, titanium (Ti), titanium nitride (TiNx), platinum (Pt), tantalum (Ta), tantalum nitride (TaNx), neodymium (Nd), scandium (Sc), strontium ruthenium oxide (SRO), zinc oxide (ZnOx), indium tin oxide (ITO), tin oxide (SnOx), indium oxide (InOx), gallium oxide (GaOx), indium zinc oxide (IZO), etc. These may be used alone or in combination. In an exemplary embodiment of the inventive concept, the gate pattern may have a single layer structure or a multi layer structure, which may include a metal film, an alloy film, a metal nitride film, a conductive metal oxide film and/or a transparent conductive film.

The gate pattern may include a signal line to transmit signals for driving the pixel and a storage electrode. For example, the gate pattern may include a first gate electrode GE1, a second gate electrode GE2 (of TFT2) and the first gate line GL1.

The first gate line GL1 may be extended along a first direction D1. The first gate line GL1 may be electrically connected to the first gate electrode GE1 and the second gate electrode GE2.

The first insulation layer 120 may be disposed on the first base substrate 110 on which the gate pattern is disposed. The first insulation layer 120 may be uniformly formed on the first base substrate 110 along a profile of the gate pattern. Here, the first insulation layer 120 may have a substantially small thickness, such that a stepped portion may be formed at a portion of the first insulation layer 120 adjacent to the gate pattern. The first insulation layer 120 may be formed using a silicon compound. For example, first insulation layer 120 may be formed using silicon oxide, silicon nitride, silicon oxynitride, silicon oxycarbide, aluminum, magnesium, zinc, hafnium, zirconium, titanium, tantalum, aluminum oxide, titanium oxide, tantalum oxide, magnesium oxide, zinc oxide, hafnium oxide, zirconium oxide, titanium oxide, etc. These may be used alone or in a mixture.

An active layer including a first active pattern ACT1 and a second active pattern ACT2 (of TFT2) may be disposed on the first insulation layer 120. The first active pattern ACT1 may overlap the first gate electrode GE1. The second active pattern ACT2 may overlap the second gate electrode GE2. The active layer may include a semiconductor layer consisting of amorphous silicon (a-Si:H) and an ohmic contact layer consisting of an n+ amorphous silicon (n+a-Si:H). In addition, the active layer may include an oxide semiconductor. The oxide semiconductor may include an amorphous oxide including at least one selected from the group consisting of indium (In), zinc (Zn), gallium (Ga), tin (Sn) and hafnium (Hf). More particularly, the oxide semiconductor may consist of an amorphous oxide including indium (In), zinc (Zn) and gallium (Ga), or an amorphous oxide including indium (In), zinc (Zn) and hafnium (Hf). The oxide semiconductor may include an oxide such as indium zinc oxide (InZnO), indium gallium oxide (InGaO), indium tin oxide (InSnO), zinc tin oxide (ZnSnO), gallium tin oxide (GaSnO) and gallium zinc oxide (GaZnO). For example, the active layer may include indium gallium zinc oxide (IGZO).

A data pattern may be disposed on the first insulation layer 120 on which the active layer is disposed. The data pattern may include a metal, an alloy, a conductive metal oxide, a transparent conductive material, etc. For example, the data pattern may be formed using aluminum (Al), an alloy containing aluminum, aluminum nitride (AlNx), silver (Ag), an alloy containing silver, tungsten (W), tungsten nitride (WNx), copper (Cu), an alloy containing copper, nickel (Ni), an alloy containing nickel, chrome (Cr), chrome nitride (CrNx), molybdenum (Mo), an alloy containing molybdenum, titanium (Ti), titanium nitride (TiNx), platinum (Pt), tantalum (Ta), tantalum nitride (TaNx), neodymium (Nd), scandium (Sc), strontium ruthenium oxide (SRO), zinc oxide (ZnOx), indium tin oxide (no), tin oxide (SnOx), indium oxide (InOx), gallium oxide (GaOx), indium zinc oxide (IZO), etc. These may be used alone or in combination. In an exemplary embodiment of the inventive concept, the data pattern may have a single layer structure or a multi layer structure, which may include a metal film, an alloy film, a metal nitride film, a conductive metal oxide film and/or a transparent conductive film.

The data pattern may include a signal line to transmit signals for driving the pixel and a storage electrode. For example, the data pattern may include a first source electrode SE1, a second source electrode SE2 (of TFT2), a first drain electrode DE1, a second drain electrode DE2 (of TFT2), the first data line DL1 and the second data line DL2.

The first source electrode SE1 may be overlapped with the first active pattern ACT1, and be electrically connected to the first data line DL1. The second source electrode SE2 may be overlapped with the second active pattern ACT2, and be electrically connected to the second data line DL2.

The first drain electrode DE1 may be overlapped with the first active pattern ACT1, and be spaced apart from the first source electrode SE1. The second drain electrode DE2 may be overlapped with the second active pattern ACT2, and be spaced apart from the second source electrode SE2.

The first data line DL1 and the second data line DL2 may be extended along a second direction D2 which crosses the first direction D1. The first data line DL1 and the second data line DL2 may be spaced apart from each other in the first direction D1.

The first thin film transistor TFT1 may include the first gate electrode GE1, the first active pattern ACT1, the first source electrode SE1 and the first drain electrode DEL The second thin film transistor TFT2 may include the second gate electrode GE2, the second active pattern ACT2, the second source electrode SE2 and the second drain electrode DE2.

The second insulation layer 130 may be disposed on the first insulation layer 120 on which the first and second thin film transistor TFT1 and TFT2 are disposed. The second insulation layer 130 may have a single-layered structure or a multi-layered structure including at least two insulation films. The second insulation layer 130 may be formed using an organic material. For example, the second insulation layer 130 may include a photoresist, an acryl-based resin, a polyimide-based resin, a polyamide-based resin, a siloxane-based resin, etc. These may be used alone or in combination. In addition, the second insulation layer 130 may include an inorganic material. For example, the second insulation layer 140 may be formed using silicon oxide, silicon nitride, silicon oxynitride, silicon oxycarbide, aluminum, magnesium, zinc, hafnium, zirconium, titanium, tantalum, aluminum oxide, titanium oxide, tantalum oxide, magnesium oxide, zinc oxide, hafnium oxide, zirconium oxide, titanium oxide, etc. These may be used alone or in a mixture.

The high sub-pixel electrode HPX and the low sub-pixel electrode LPX may be disposed on the second insulation layer 130. The high sub-pixel electrode HPX may be electrically connected to the first drain electrode DE1 though a contact hole which is formed through the second insulation layer 130. The low sub-pixel electrode LPX may be electrically connected to the second drain electrode DE2 though a contact hole which is formed through the second insulation layer 130. In a plan view, the high sub-pixel electrode HPX may have a polygonal shape. For example, the high sub-pixel electrode HPX may have a triangular shape. In a plan view, the low sub-pixel electrode LPX may be formed in an area where the high sub-pixel electrode HPX is not formed. For example, the low sub-pixel electrode LPX may have a first portion LPXa having a triangular shape and a second portion LPXb having a triangular shape. The first gate line GL1 may be disposed between the first portion LPXa and the second portion LPXb. The first portion LPXa and the second portion LPXb may be electrically connected to each other. In an exemplary embodiment of the inventive concept, the high sub-pixel electrode HPX and the low sub-pixel electrode LPX may have substantially the same size. In an exemplary embodiment of the inventive concept, the high sub-pixel electrode HPX and the low sub-pixel electrode LPX may have different sizes from each other.

Voltages applied to the high sub-pixel electrode HPX and the low sub-pixel electrode LPX may be different from each other. For example, a first pixel voltage may be applied to the high sub-pixel electrode HPX through the first data line DL1, and a second pixel voltage may be applied to the low sub-pixel electrode LPX through the second data line DL2.

The high sub-pixel electrode HPX and the low sub-pixel electrode LPX may include a transparent conductive material. For example, the high sub-pixel electrode HPX and the low sub-pixel electrode LPX may include indium tin oxide (ITO) or indium zinc oxide (IZO). In addition, the high sub-pixel electrode HPX and the low sub-pixel electrode LPX may include titanium (Ti) or a molybdenum titanium alloy (MoTi).

The first alignment layer 140 may be disposed on the second insulation layer 130 on which the high sub-pixel electrode HPX and the low sub-pixel electrode LPX are disposed. For example, a photoreactive polymer of a cinnamate group and a blend of polymers of a polyimide group are spread and hardened on the high sub-pixel electrode HPX and the low sub-pixel electrode LPX, so that the first alignment layer 140 may be formed.

The first substrate 100 may further include a first polarizer.

The second substrate 200 may disposed to face the first substrate 100. The second substrate 200 may include a second base substrate 210, a light blocking pattern BM, a color filter CF, an over-coating layer 220, a common electrode CE and a second alignment layer 230.

The second base substrate 210 may include a transparent insulation substrate. For example, the second base substrate 210 may include a glass substrate, a quartz substrate, a transparent resin substrate, etc. Examples of the transparent resin substrate for the second base substrate 210 may include a polyimide-based resin, an acryl-based resin, a polyacrylate-based resin, a polycarbonate-based resin, a polyether-based resin, a sulfonic acid containing resin, a polyethyleneterephthalate-based resin, etc. In addition, the second base substrate 210 may include a flexible material, so that the display panel may be a flexible display panel or a curved display panel.

The light blocking pattern BM may be disposed on the second base substrate 210. The light blocking pattern BM may include an organic material or an inorganic material which can block light. For example, the light blocking pattern BM may be a black matrix pattern including chrome oxide. The light blocking pattern BM may be disposed any place where light is to be blocked. For example, the light blocking pattern BM may disposed to overlap the first and second thin film transistors TFT1 and TFT2, and the first gate line GL1. Accordingly, the light blocking pattern BM disposed in the middle of the pixel may divide the pixel into two portions along the second direction D2.

The color filter CF may be disposed on the second base substrate 210 on which the light blocking pattern BM is formed. The color filter CF may be disposed on the light blocking pattern BM and the second base substrate 210. The color filter CF supplies colors to light passing through the liquid crystal layer 300. The color filter CF may include a red color filter, a green color filter and blue color filter. The color filter CF corresponds to a pixel area. The color filters adjacent to each other may have different colors. The color filter CF may be overlapped with an adjacent color filter CF in a boundary of the pixel area, or the color filter CF may be spaced apart from an adjacent color filter CF in the boundary of the pixel area. The color filter CF may overlap the high sub-pixel electrode HPX and the low sub-pixel electrode LPX. The high sub-pixel electrode HPX and the low sub-pixel electrode LPX in one pixel may overlap a color filter CF having the same color.

The over-coating layer 220 may be disposed on the first to third color filters CF (e.g., red, green and blue) and the light blocking pattern BM. The over-coating layer 220 may flatten the color filters CF, protect the color filters CF, and insulate the color filters CF. The over-coating layer 220 may include an acrylic-epoxy material.

The common electrode CE may include a transparent conductive material. For example, the common electrode CE may include indium tin oxide (ITO) or indium zinc oxide (IZO). In addition, the common electrode CE may include titanium (Ti) or molybdenum titanium alloy (Mo Ti).

The second alignment layer 230 may be disposed on the common electrode CE. For example, a photoreactive polymer of a cinnamate group and a blend of polymers of a polyimide group are spread and hardened on the common electrode CE, so that the second alignment layer 230 may be formed.

The second substrate 200 may further include a second polarizer, and a polarizing axis of the second polarizer may be substantially perpendicular to that of the first polarizer.

The liquid crystal layer 300 may be disposed between the first substrate 100 and the second substrate 200. The liquid crystal layer 300 may include liquid crystal molecules having optical anisotropy. The liquid crystal molecules may be driven by an electric field, so that an image may be displayed by passing or blocking light through the liquid crystal layer 300. The liquid crystal molecules of the liquid crystal layer 300 may be driven with a vertical alignment (VA) mode by the first and second alignment layers 140 and 230, so that long axes of the liquid crystal molecules are substantially perpendicular to the first and second substrates 100 and 200 when the electric field is not applied.

Figure 12A:
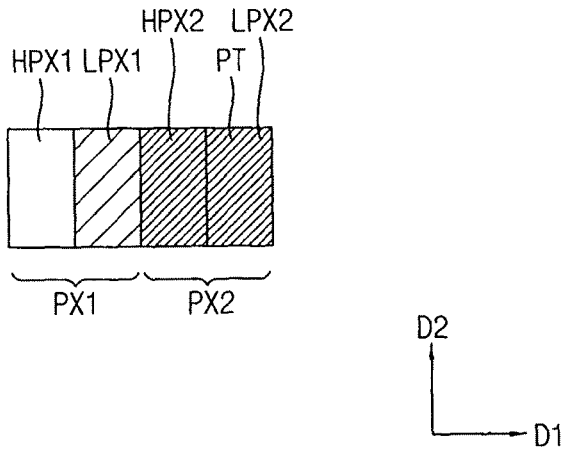
FIGS. 12A and 12B are plan views illustrating several pixels of a display panel according to an exemplary embodiment of the inventive concept.
Figure 12B:
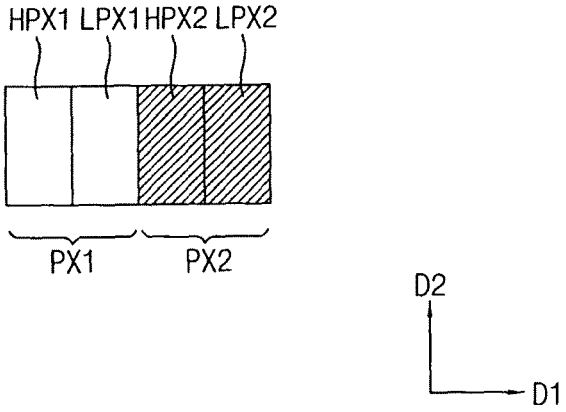

FIGS. 12A and 12B are plan views illustrating several pixels of a display panel according to an exemplary embodiment of the present inventive concept.

Referring to FIG. 12A, the display panel may include a first pixel PX1 and a second pixel PX2 which is adjacent to the first pixel PX1 in a first direction D1.

The first pixel PX1 may be divided into a first high sub-pixel HPX1 and a first low sub-pixel LPX1. The first high sub-pixel HPX1 and the first low sub-pixel LPX1 may be arranged in the first direction D1. Each of the first high sub-pixel HPX1 and the first low sub-pixel LPX1 may have a width in the first direction D1 and a length in a second direction D2 which is substantially perpendicular to the first direction D1. The length may be greater than or equal to the width. For example, each of the first high sub-pixel HPX1 and the first low sub-pixel LPX1 may have a rectangular shape which has a long side in the second direction D2.

The second pixel PX2 may be divided into a second high sub-pixel HPX2 and a second low sub-pixel LPX2. The second high sub-pixel HPX2 and the second low sub-pixel LPX2 may be arranged in the first direction D1. Each of the second high sub-pixel HPX2 and the second low sub-pixel LPX2 may have a width in the first direction D1 and a length in the second direction D2. The length may be greater than or equal to the width. For example, each of the second high sub-pixel HPX2 and the second low sub-pixel LPX2 may have a rectangular shape which has a long side in the second direction D2.

When a black gray value which corresponds to a specific pattern PT is applied to the second pixel PX2, and a white or gray gray value is applied to the first pixel PX1, the first low sub-pixel LPX1 of the first pixel PX1 which is adjacent to the second pixel PX2 is the adjacent pixel. The first low sub-pixel LPX1 of the first pixel PX1 may display a darker gray level than its intended gray level due to the effect of the second pixel PX2 which is the specific pixel and has the black gray value.

Referring to FIG. 12B, here, according to the driving method of the inventive concept, gray values of the first low sub-pixel LPX1 of the first pixel PX1 may be changed to a brighter value, so that a fuzz at a boundary of the specific pattern PT may be reduced. Accordingly, a display quality of a display panel may be increased.

Figure 13A:
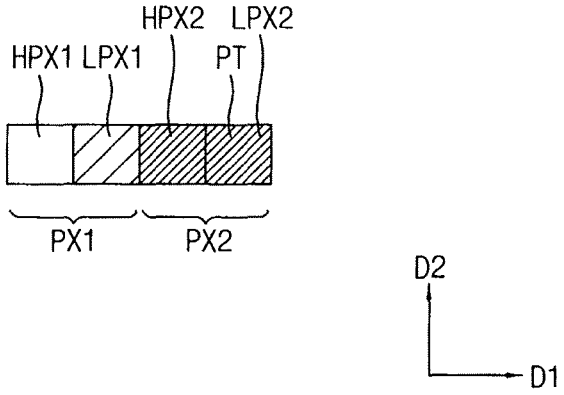
FIGS. 13A and 13B are plan views illustrating several pixels of a display panel according to an exemplary embodiment of the inventive concept.
Figure 13B:
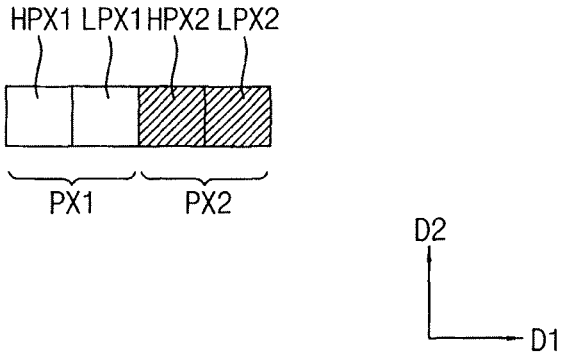

FIGS. 13A and 13B are plan views illustrating several pixels of a display panel according to an exemplary embodiment of the inventive concept.

Referring to FIG. 13A, the display panel may include a first pixel PX1 and a second pixel PX2 which is adjacent to the first pixel PX1 in a first direction D1.

The first pixel PX1 may be divided into a first high sub-pixel HPX1 and a first low sub-pixel LPX1. The first high sub-pixel HPX1 and the first low sub-pixel LPX1 may be arranged in the first direction D1. The first pixel PX1 may have a width in the first direction D1 and a length in a second direction D2 which is substantially perpendicular to the first direction D1. The length may be equal to the width. For example, the first pixel PX1 may have a square shape.

The second pixel PX2 may be divided into a second high sub-pixel HPX2 and a second low sub-pixel LPX2. The second high sub-pixel HPX2 and the second low sub-pixel LPX2 may be arranged in the first direction D1. The second pixel PX2 may have a width in the first direction D1 and a length in the second direction D2. The length may be equal to the width. For example, the second pixel PX2 may have a square shape.

When a black gray value which corresponds to a specific pattern PT is applied to the second pixel PX2, and a white or gray gray value is applied to the first pixel PX1, the first low sub-pixel LPX1 of the first pixel PX1 which is adjacent to the second pixel PX2 is the adjacent pixel. The first low sub-pixel LPX1 of the first pixel PX1 may display a darker gray level than its intended gray level due to the effect of the second pixel PX2 which is the specific pixel and has the black gray value.

Referring to FIG. 13B, here, according to the driving method of the inventive concept, gray values of the first low sub-pixel LPX1 of the first pixel PX1 may be changed to a brighter value, so that a fuzz at a boundary of the specific pattern PT may be reduced. Accordingly, a display quality of a display panel may be increased.

According to an exemplary embodiment of the present inventive concept, a display panel includes a pixel having a high sub-pixel and a low sub-pixel. Gray values of the high and low sub-pixels of pixels adjacent to specific pixels may be individually controlled. Accordingly, a fuzz at a boundary of a specific pattern, which includes the specific pixels, may be reduced.

For example, when the display panel is a curved display having a curved surface and is driven by a vertical alignment mode, fuzzy text may be reduced. Accordingly, a display quality (e.g., visibility) of the display panel may be increased.

While the present inventive concept has been particularly shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. A method of driving a display panel, the display panel comprising a plurality of pixels arranged in a matrix, each of the pixels comprising a high sub-pixel and a low sub-pixel, the method comprising:

detecting a first pixel which corresponds to a first pattern in an image, wherein the first pixel corresponds to the first pattern when a gray scale value of the high or low sub-pixel of the first pixel is within a predetermined range;

detecting a second pixel that does not correspond to the first pattern, wherein the second pixel does not correspond to the first pattern when a gray scale value of the high or low sub-pixel of the second pixel is outside the predetermined range; and changing the gray scale value of the high or low sub-pixel of the second pixel which is adjacent to the first pixel to correspond to a color of a gray scale value of the high or low sub-pixel of the second pixel which is not adjacent to the first pixel.

2. The method of claim 1, wherein the high sub-pixels of the second pixel are driven by a first gamma curve, and the low sub-pixels of the second pixel are driven by a second gamma curve which is different from the first gamma curve.

3. The method of claim 2, wherein when the gray scale value of the high or low sub-pixel of the second pixel which is adjacent to the first pixel is changed, the gray scale value of the high or low sub-pixel of the second pixel which is not adjacent to the first pixel is not changed.

4. The method of claim 3, wherein the second pixel is adjacent to the first pixel in a direction in which a data line is extended, and the gray scale value of the high or low sub-pixel of the second pixel which is closer to the first pixel is changed.

5. The method of claim 4, wherein the gray scale value of the high or low sub-pixel of the second pixel is changed when an image produced at the high or low sub-pixel of the second pixel is darker than an image intended to be produced at the high or low sub-pixel of the second pixel.

6. The method of claim 4, wherein the gray scale value of the high or low sub-pixel of the second pixel is changed when an image produced at the high or low sub-pixel of the second pixel is brighter than an image intended to be produced at the high or low sub-pixel of the second pixel.

7. The method of claim 1, wherein the first pixel is detected by deciding whether a difference between gray scale values of continuous pixels is greater than 50% of the predetermined range or not.

8. The method of claim 1, wherein the first pattern is text.

9. The method of claim 1, wherein the high sub-pixel and the low sub-pixel of the first pixel or the high-sub pixel and the low sub-pixel of the second pixel are electrically connected to different switching elements.

10. The method of claim 9, wherein the high sub-pixel and the low sub-pixel in one of the first or second pixels are overlapped with a color filter which has one color.

11. The method of claim 10, wherein the high sub-pixel and the low sub-pixel in the one pixel are arranged along a direction in which a data line is extended.

12. The method of claim 11, wherein a light blocking pattern divides the one pixel into two portions.

13. The method of claim 10, wherein the display panel further comprises a liquid crystal layer, and the display panel is driven by a vertical alignment mode.

14. The method of claim 10, wherein the display panel is a curved display panel which displays an image on a curved surface.

15. The method of claim 10, wherein the high sub-pixel and the low sub-pixel in the one pixel are arranged along a direction in which a gate line is extended.

16. A method of driving a display panel, which comprises a plurality of pixels arranged in a matrix form, each pixel having a high sub-pixel and a low sub-pixel, the method comprising:

detecting a first pixel which corresponds to text, wherein the first pixel corresponds to the text when a gray scale value of the high or low sub-pixel of the first pixel is within a predetermined range;

detecting a second pixel that does not correspond to the text, wherein the second pixel does not correspond to the text when a gray scale value of the high or low sub-pixel of the second pixel is outside the predetermined range; and correcting the gray scale value of the high or low sub-pixel of the second pixel, which is adjacent to the first pixel, to have a brighter value or a darker value that corresponds to a color of a gray scale value of the high or low sub-pixel of the second pixel which is not adjacent to the first pixel.

* * * * *